US006405009B1

(12) United States Patent
Shinkawa et al.

(10) Patent No.: US 6,405,009 B1
(45) Date of Patent: Jun. 11, 2002

(54) IMAGE FORMING APPARATUS INCLUDING SYSTEM FOR RECYCLING TONER

(75) Inventors: Kouji Shinkawa; Takashi Sakai, both of Nara; Takayuki Yamanaka, Tenri; Atsushi Inoue, Nara; Jitsuo Masuda, Yamatotakada, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/679,614

(22) Filed: Oct. 5, 2000

(30) Foreign Application Priority Data

Oct. 5, 1999 (JP) ..... 11-284318
Dec. 14, 1999 (JP) ..... 11-355132

(51) Int. Cl.[7] ..... G03G 15/08
(52) U.S. Cl. ..... 399/253; 399/359
(58) Field of Search ..... 399/253, 358–360

(56) References Cited

U.S. PATENT DOCUMENTS 5,200,788 A * 4/1993 Thayer ..... 399/359
5,307,128 A * 4/1994 Murasaki et al. ..... 399/359 X
5,481,351 A * 1/1996 Kawai et al. ..... 399/359
5,734,957 A * 3/1998 Ogawa et al. ..... 399/359
5,906,906 A * 5/1999 Inoue et al. ..... 399/359 X

FOREIGN PATENT DOCUMENTS

JP 5-216267 A 8/1993
JP 6-130810 A 5/1994
JP 8-185101 A 7/1996

OTHER PUBLICATIONS

U.S. Application Serial No. 09/359,314, filed Jul. 23, 1999, entitled "Toner Replenishing Apparatus and Image Forming Apparatus Equipped with Same".

* cited by examiner

*Primary Examiner*—William J. Royer
(74) *Attorney, Agent, or Firm*—Nixon & Vanderhye P.C.

(57) ABSTRACT

In image forming apparatuses producing recycled toner from residual toner and recycling the recycled toner, the toner composition changes, and the toner properties worsen, because the external additive contained in the collected residual toner that is collected with a cleaning portion decreases during the image formation. The residual toner that has been collected with the cleaning portion is conveyed through a conveyance path to a collected residual toner storage, and external additive is supplemented from an external additive cartridge, and mixed with being stirred to produce recycled toner. In a fresh toner storage, fresh toner and recycled toner are stirred, and when the amount of toner in a developing portion drops below a predetermined amount, toner is conveyed from the fresh toner storage through a conveyance path to the developing portion. The toner that has been conveyed to the developing portion is supplied to a photosensitive drum.

28 Claims, 15 Drawing Sheets

○ FRESH TONER
◎ RECYCLED TONER
● RESIDUAL TONER
△ EXTERNAL ADDITIVE PARTICLES

IMAGE FORMING APPARATUS INCLUDING SYSTEM FOR RECYCLING TONER

BACKGROUND OF THE INVENTION

1. Field of the Invention

The present invention relates to an image forming apparatus capable of recycling residual toner on the photosensitive drum surface after forming an image in an image forming method such as electrophotography. More specifically, the invention relates to an image forming apparatus, in which recovered toner is not used as it is, but its external additive concentration is returned to an appropriate level to turn it into recycled toner with the same properties as fresh toner, and recycle this recycled toner.

2. Description of the Related Art

Conventionally, image forming apparatuses using electrophotography are widely used. In electrophotography, an electrostatic latent image, which has been formed on the surface of a photosensitive drum serving as an electrostatic latent image carrier, is developed with toner, transferred onto a sheet of recording paper or the like and ejected. In such an apparatus, the toner on the photosensitive drum is not necessarily transferred entirely to the sheet, and some of it remains on the surface of the photosensitive drum. After the residual toner that has remained on the photosensitive drum has been removed in a cleaning step, it is recovered in a toner container, such as a toner bottle, and disposed of. That is to say, in conventional methods, recovered toner is not recycled.

In recent years, image forming apparatuses have become much faster, and the number of images printed per unit time has grown very high, so that also the amount of residual toner has grown to large quantities. The principle component of the residual toner is a binder resin, and disposing large quantities thereof may lead to environmental pollution.

Under these circumstances, there has been much talk in recent years about pollution of the environment and the efficient use of natural resources, so that a strong demand for the recycling of residual toner in image forming apparatuses has developed.

One method that is used for this is to supply the toner that has been eliminated or recovered in a cleaning step as it is to a developing unit via conveying means.

FIGS. 15A and 15B show a conventional image forming apparatus 200 that can recycle residual toner. FIG. 15A shows the general configuration of this conventional image forming apparatus 200, which can recycle residual toner. FIG. 15B is a magnification showing the general configuration of the image forming portion of the image forming apparatus 200 shown in FIG. 15A.

The image forming portion of the image forming apparatus 200 includes a charging unit 202, an exposure device 203, a developing unit 204, a transfer device 205, a peel-off device 208, a cleaning device 206, and a discharger 207 arranged around a rotatable cylindrical photosensitive drum 201 serving as an electrostatic latent image carrier and having an organic photoconducting photosensitive layer, as well as a toner recycling portion 209, which conveys the residual toner that has been recovered with the cleaning device 206 to the developing unit 204.

The image formation is carried out in the following order. To carry out an image formation, the photosensitive drum 201 is first rotated in the arrow direction A, and the surface of the photosensitive drum 201 is charged uniformly with the charging unit 202. Then, the exposure device 203 exposes photosensitive drum 201 in correspondence with the original document. This forms on the surface of the photosensitive drum 201 an electrostatic latent image corresponding to the original document. In the developing unit 204, this electrostatic image is made visible by supplying toner with a developing roller 204*d*. The toner image is transferred by the transfer device 205 onto a transfer material, such as a piece of paper, which has been conveyed from a paper feed portion 210. After the transfer material, onto which the toner has been transferred, has been subjected to a fixing process with the fixing device 211, it is ejected out of the image forming apparatus.

After the transfer step, the residual toner that has remained on the surface is scraped off the photosensitive drum 201 with a cleaning blade 206*a* of the cleaning device 206, and the charge on the surface of the photosensitive drum 201 is eliminated with the discharger 207. Then, the surface of the photosensitive drum 201 is uniformly charged again with the cleaning unit 202, and the above steps are repeated.

The residual toner that has been recovered by the cleaning device 206 is conveyed through the toner recycling portion 209, which is provided with a screw, to the developing unit 204, is mixed with the toner that has accumulated in the developing unit 204 while being stirred, and is used again for making electrostatic latent images on the photosensitive drum 201 visible. The replenishing of fresh toner is performed from a toner cartridge 212, serving as a toner supply portion, provided at the top of the developing unit 204.

In the above-described series of image forming steps, matter generated by the corona charging and foreign matter, such as paper particles or talc, which is contained in the paper sheets or other transfer material, adheres to the surface of the photosensitive drum 201, in addition to the residual toner. In the image forming apparatus shown in FIGS. 15A and 15B, if foreign matter, such as particles of the paper sheets or toner coagulates, is conveyed through the toner recycling portion 209 to the developing unit 204 together with the toner, then this may adversely influence the following image forming steps, and when foreign matter is supplied together with the toner to the surface of the photosensitive drum 201, a decline of the image quality, such as blank spots in the image, may occur. There is also the possibility that the surface of the photosensitive drum 201 is damaged. Consequently, to recycle the residual toner that has been recovered, it was necessary to recycle the residual toner by some means.

A technique that has been proposed to solve this problem is to carry out a recycling process, in which the recovered toner is passed through a lattice-shaped filter (mesh), and foreign matter mixed into the recovered toner is eliminated, as for example in the image forming -method disclosed in Japanese Unexamined Patent Publication JP-A 8-185101 (1996). This technique also carries out a process in which the separatability of the foreign matter from the recovered toner is improved. With this technique, it is possible to obtain a recycled toner that can maintain a high image density from beginning to end, and without covering of the document with toner and toner scattering.

In the toner cartridge disclosed in Japanese Unexamined Patent Publication JP-A 6-130810 (1994), a residual toner storage tank for collecting residual toner is coupled to and formed in one piece with a fresh toner storage tank for supplying fresh toner to the developing unit. The residual toner is mixed with the fresh toner, and this toner mixture of residual toner and fresh toner is supplied to the developing unit via a conveyance duct, and thereby recycled. A wall in which holes with small diameter are formed or a lattice-shaped wall is provided between the residual toner storage tank and the fresh toner storage tank, which prevents that foreign matter or residual toner particles with large particle diameter are transferred to the fresh toner storage tank. Furthermore, this cartridge also improves the conveyability and the chargeability of the residual toner by mixing the fresh toner and the residual toner while stirring.

Although this toner cartridge improves the properties of the residual toner, the properties of the fresh toner, which is mixed with the residual toner, deteriorate. Therefore, it cannot provide a mixed toner of high quality. The reason for this is that not only are impurities mixed into the recovered residual toner, but the composition of the toner itself changes. That is to say, the residual toner's conveyability (flow properties) and the chargeability (ability to be charged by friction) worsen due to this composition change. Therefore, it is not possible to form a high-quality image just by eliminating the foreign matter.

To solve this problem, the previously mentioned JP-A 8-185101 discloses a toner recycling method, in which the recovered residual toner is passed through a lattice-shaped filter (mesh), impurities are eliminated, and the flowability index is decreased to 70 or less by adding a halide of an azo iron complex to the recycled toner.

However, this addition process is not a recycle process by which the composition of the toner is restored, so that a recycled toner of sufficient quality cannot be attained. Furthermore, a maximum of 20 parts by weight of the halide of an azo iron complex are added to 100 parts by weight of the toner, which is not practical with regard to costs. Also, in an image forming apparatus using this addition process, the separation device serving as the component for recycling the residual toner has a complicated structure. Therefore, the steps for manufacturing the image forming apparatus become complicated, and the number of parts increases, so that the manufacturing costs rise.

On the other hand, the configuration of the toner cartridge disclosed in JP-A 6-130810 focuses only on the recycling of recovered residual toner, so that the worsening of the properties of fresh toner due to the mixing with residual toner is not considered. That is to say, the residual toner is transferred directly into the fresh toner storage tank and mixed, so that it is not possible to control the mixing ratio of residual toner and fresh toner. Therefore, for example at the beginning of the image formation, the mixing ratio of residual toner to fresh toner is low, so that a favorable image quality can be attained, but if image formation is repeated without replenishing fresh toner, the mixing ratio of residual toner to fresh toner gradually becomes high, and the image quality tends to worsen. Especially when printing large amounts of black beta images with high text density, large amounts of the toner mixture of fresh toner and residual toner are consumed, and as a result, large amounts of the residual toner are recovered and mixed again, so that the above problems are even more pronounced.

SUMMARY

It is an object of the invention to solve these problems and to provide an image forming apparatus in which recycled toner with high quality can be produced from residual toner and reused.

The invention provides an image forming apparatus comprising a developing unit for supplying toner to an electrostatic latent image formed on an electrostatic latent image carrier and making the electrostatic latent image visible; a transfer device for transferring the toner image made visible onto a transfer material; a cleaning device for eliminating and collecting residual toner remaining on the electrostatic latent image carrier after transferring the toner image; a conveyor device for conveying residual toner that has been collected by the cleaning device, to the developing unit; and a toner recycling portion for producing recycled toner by supplementing an external additive to the collected residual toner conveyed to the developing unit, wherein the resulting recycled toner is reused for image formation.

According to the invention, the residual toner that has been eliminated and collected with the cleaning device is conveyed to the developing unit with the conveyor device, and the image forming apparatus is provided with the toner recycling portion for producing recycled toner by supplementing an external additive to the collected residual toner. Consequently, the amount of external additive contained in the collected residual toner is substantially the same as in fresh toner, which improves the charge stability, developing properties, flow properties and durability of the recycled toner. Moreover, with the recycled toner produced with this image forming apparatus, an image formation can be realized that is substantially as reliable as with fresh toner.

In another aspect of the invention, the external additive is a powder of at least one of silica, alumina and titania.

In accordance with this aspect of the invention, the recycled toner is produced by adding to the collected residual toner at least one powder of silica, alumina and titania as an external additive. Consequently, the residual toner can be recycled easily, because these powders are regular materials that are easy to acquire.

In another aspect of the invention, an amount of the external additive which is supplemented to the collected residual toner in the toner recycling portion satisfies the following equation:

$$0.9Y-X \leqq Z \leqq 1.1Y-X$$

wherein Y[% by weight] is weight ratio of external additive contained in fresh toner, and X[% by weight] is weight ratio of external additive contained in the collected residual toner, and Z [% by weight] is weight ratio of the external additive to be supplemented to the collected residual toner.

In accordance with this aspect of the invention, the amount of the external additive to be supplemented to the collected residual toner can be set to be within ±10% of that included in fresh toner. Thus, the composition of the recycled toner can be restored favorably, and it is possible to produce toner of a quality that is substantially the same as that of fresh toner.

In another aspect of the invention, the toner recycling portion includes foreign matter eliminating means for eliminating foreign matter that is contained in the collected residual toner.

In accordance with this aspect of the invention, the toner recycling portion includes the foreign matter eliminating means for eliminating foreign matter that is contained in the collected residual toner. Consequently, it is possible to prevent image deficiencies and damage to the photosensitive drum surface.

In another aspect of the invention, the foreign matter eliminating means is cup-shaped, at least a bottom portion of the foreign matter eliminating means is made of a mesh, and the foreign matter eliminating means is provided detachably in an aperture portion of the toner recycling portion.

In accordance with this aspect of the invention, at least the bottom portion of the foreign matter eliminating means is made of a mesh, and the foreign matter eliminating means is detachable. Consequently, foreign matter contained in the collected residual toner can be eliminated easily before the recycled toner is produced in the toner recycling portion. Furthermore, the foreign matter that has accumulated in the foreign matter eliminating means can be removed easily and reliably.

In another aspect of the invention, a size of holes in the mesh of the foreign matter eliminating means is larger than a diameter of residual toner particles to be recycled and smaller than a particle diameter of the foreign matter to be eliminated.

In accordance with this aspect of the invention, the size of the holes in the mesh provided at the bottom portion of the foreign matter eliminating means is smaller than the particle diameter of the foreign matter to be eliminated and collected and larger than the diameter of the residual toner particles to be recycled. Thus, the foreign matter can be reliably separated and eliminated from the collected residual toner reliably, and the clogging of the mesh with residual toner can be avoided.

In another aspect of the invention, the toner recycling portion includes a collected residual toner storage for storing collected residual toner; an external additive cartridge for storing the external additive; and a connection portion connecting the collected residual toner storage and the external additive cartridge.

In accordance with this aspect of the invention, the external additive cartridge is connected to the collected residual toner storage through the connection portion. Consequently, the external additive stored in the external additive cartridge can be supplied easily through the connection portion to the collected residual toner storage.

In another aspect of the invention, the external additive cartridge is attached detachably to a top of the collected residual toner storage.

In accordance with this aspect of the invention, the external additive cartridge is attached detachably to the collected residual toner storage. Consequently, the external additive cartridge can be exchanged easily after the addition of external additive.

In another aspect of the invention, the external additive cartridge is provided with an aperture portion sealed with a heat seal, which connects the external additive cartridge with the collected residual toner storage when the heat seal is removed.

In accordance with this aspect of the invention, the aperture portion of the external additive cartridge storing the external additive is sealed with a heat seal, so that external additive does not spill out, and when the heat seal is removed, the aperture portion connects the external additive cartridge with the collected residual toner storage. Consequently, users can supply external additive to the collected residual toner storage easily without making their hands dirty by removing the heat seal. Furthermore, with this configuration, a used up empty cartridge or a new external additive cartridge that has been substituted can be used with the lid of the collected residual toner storage.

In another aspect of the invention, the collected residual toner storage includes stirring means for stirring the collected residual toner and the external additive.

In accordance with this aspect of the invention, the collected residual toner storage includes stirring means for stirring the collected residual toner and the external additive. Consequently, it is easy to produce recycled toner whose properties are the same as those of fresh toner by stirring the external additive supplied to the collected residual toner storage and the collected residual toner collected from the electrostatic latent image carrier with the stirring means.

In another aspect of the invention, the image forming apparatus further comprises collected residual toner detection means for detecting an amount of toner in the collected residual toner storage; and notification means for notifying, when the amount of toner detected by the collected residual toner detection means has reached an amount equal to or larger than a first predetermined amount.

In accordance with this aspect of the invention, the amount of collected residual toner in the collected residual toner storage is detected with the collected residual toner detection means, and when this amount of toner is equal to or larger than a first predetermined amount, the user is notified of the fact that this amount of toner is equal to or larger than the first predetermined amount. Consequently, the user can easily confirm that the amount of collected residual toner that has been collected has reached the first predetermined amount. This makes it easy to produce recycled toner of an appropriate composition, and prevents the deterioration of the quality of the recycled toner.

In another aspect of the invention, the image forming apparatus further comprises control means for stopping image formation when the toner amount detected by the collected residual toner detection means has reached a second predetermined amount.

In accordance with this aspect of the invention, the image formation is stopped when the collected residual toner has reached the second predetermined amount. Thus, it is possible to strongly urge the user to produce recycled toner when the user has forgotten to supply external additive, to prevent the collected residual toner from exceeding the second predetermined amount, and to reliably produce recycled toner of an appropriate composition.

In another aspect of the invention, the toner recycling portion includes a fresh toner storage in which recycled toner is mixed with fresh toner; and a connection portion for connecting the fresh toner storage with the collected residual toner storage.

In accordance with this aspect of the invention, the fresh toner storage is connected by the connection portion with the collected residual toner storage, to mix the fresh toner with recycled toner. Consequently, recycled toner is conveyed through the connection portion from the collected residual toner storage, and fresh toner is mixed before use with the recycled toner in the fresh toner storage, so that the image quality can be improved even more than using only recycled toner.

In another aspect of the invention, the fresh toner storage includes fresh toner detection means for detecting a toner amount, and notification means for notifying, when the amount of toner detected by the fresh toner detection means has decreased to an amount equal to or smaller than a predetermined amount, a user of the decrease.

In accordance with this aspect of the invention, when the fresh toner detection means has detected that the amount of toner in the fresh toner storage has decreased to an amount equal to or smaller than a predetermined amount, the notification means notifies the user of the decrease. Consequently, when the toner in the fresh toner storage used for developing is running short, the user can be urged to replenish fresh toner and a deterioration of the image quality due to toner shortage can be avoided.

Another image forming apparatus in accordance with the invention comprises a developing unit for supplying toner to an electrostatic latent image that has been formed on an electrostatic latent image carrier to form a toner image; a transfer device for transferring the toner image onto a transfer material; a cleaning device for eliminating and collecting residual toner remaining on a surface of the electrostatic latent image carrier after transferring the toner image; and a toner recycling portion for producing recycled toner by stirring collected residual toner that has been collected with the cleaning device and high concentration toner containing an external additive whose concentration is higher than that of fresh toner, wherein the collected residual toner is reused for image formation as recycled toner.

In an image forming apparatus in accordance with the invention, (i) residual toner that has remained on the surface of the electrostatic latent image carrier and eliminated and collected with the cleaning device and (ii) high concentration toner containing an external additive whose concentration is higher than that of fresh toner are mixed while being stirred in a toner recycling portion so as to produce recycled toner. Consequently, a concentration of external additive in a collected residual toner can be increased, and the collected residual toner with enhanced quality can be recycled.

In another aspect of the invention, the external additive is a powder of at least one of silica, alumina and titania.

In accordance with this aspect of the invention, at least one of silica, alumina and titania is added to the collected residual toner as an external additive. Consequently, the quality of the residual toner can be improved easily to reuse as recycled toner, because these powders are regular materials that are easy to acquire.

In another aspect of the invention, the external additive has a hydrophobicity of at least 40%.

In accordance with this aspect of the invention, the external additive, which is made of a powder of at least one of silica, alumina and titania, has a hydrophobization degree of at least 40%. Consequently, variations in the chargeability of the toner can be suppressed even under high temperatures and high humidities.

In another aspect of the invention, the foreign matter eliminating means is cup-shaped, at least a bottom portion of the foreign matter eliminating means is composed of a mesh, and a size of holes in the mesh is larger than a diameter of toner particles to be recycled and smaller than a particle diameter of the foreign matter to be eliminated.

In accordance with this aspect of the invention, the size of the holes in the mesh provided at the bottom portion of the foreign matter eliminating means is smaller than the particle diameter of the foreign matter to be eliminated and collected and larger than the diameter of the collected residual toner particles to be recycled. Thus, the foreign matter can be reliably separated and eliminated from the collected residual toner.

In another aspect of the invention, the foreign matter eliminating means includes foreign matter detection means for detecting an amount of matter collected in the foreign matter eliminating means; and notification means for notifying, when the amount of collected matter has reached a predetermined amount.

In accordance with this aspect of the invention, when the foreign matter detection means has detected that the amount of matter collected in the foreign matter eliminating means has reached a predetermined amount, then this fact is announced by the notification means. Consequently, the user of the image forming apparatus does not have to constantly check the amount of matter collected in the foreign matter eliminating means.

In another aspect of the invention, the foreign matter eliminating means includes foreign matter stirring means for stirring the matter collected in the foreign matter eliminating means.

In accordance with this aspect of the invention, foreign matter stirring means stirs the matter collected in the foreign matter eliminating means. Consequently, toner that can be recycled can be collected reliably, even when foreign matter and toner coagulations with large diameter have accumulated in the foreign matter eliminating means and toner that can be recycled adheres to the foreign matter, for example, because the collected residual toner is stirred when being passed through the foreign matter eliminating means.

In another aspect of the invention, the toner recycling portion includes a collected residual toner storage for storing collected residual toner; a high concentration toner accommodating portion for accommodating high concentration toner containing an external additive whose concentration is higher than that of fresh toner; a conveyance path for conveying collected residual toner from the collected residual toner storage to the high concentration toner accommodating portion; and stirring means for stirring toner in the high concentration toner accommodating portion.

In accordance with this aspect of the invention, collected residual toner that has accumulated in the collected residual toner storage is conveyed through the conveyance path to the high concentration toner accommodating portion, and the collected residual toner and the high concentration toner are stirred by the stirring means in the high concentration toner accommodating portion, which stores high concentration toner containing an external additive whose concentration is higher than that of fresh toner. Consequently, the collected residual toner and the high concentration toner are stirred in the high concentration toner accommodating portion to produce recycled toner, so that a recycled toner of high quality can be used to carry out the image formation.

In another aspect of the invention, the toner recycling portion includes a fresh toner storage for storing fresh toner; a conveyance path for conveying recycled toner from the high concentration toner accommodating portion to the fresh toner storage; and stirring means for stirring toner in the fresh toner storage.

In accordance with this aspect of the invention, recycled toner that has been produced in the high concentration toner accommodating portion is conveyed through the conveyance path to the fresh toner storage where fresh toner is stored, and the stirring means stirs the fresh toner and the recycled toner are stirred by the stirring means. Consequently, the image formation is carried out not only with recycled toner, but after stirring the recycled toner with fresh toner, so that images can be formed with even higher quality.

In another aspect of the invention, the collected residual toner storage includes toner detection means for detecting an amount of toner stored in the collected residual toner storage; and means for conveying toner that has been stored in the collected residual toner storage to the high concentration toner accommodating portion.

In accordance with this aspect of the invention, the collected residual toner storage is provided with the toner detection means for detecting an amount of toner that has been collected and the means for stirring and conveying toner that has been stored in the collected residual toner storage to the high concentration toner accommodating portion. Consequently, when the amount of toner stored in the collected residual toner storage reaches a predetermined amount, the toner can be conveyed to the high concentration toner accommodating portion.

In another aspect of the invention, the toner recycling portion includes a toner accommodating portion for accommodating high concentration toner containing an external additive whose concentration is higher than that of fresh toner; a conveyance path for conveying collected residual toner that has been collected with the cleaning device to the toner accommodating portion; and stirring means for stirring the toner in the toner accommodating portion.

In accordance with this aspect of the invention, the collected residual toner that has been collected with the cleaning device is conveyed through the conveyance path to the toner accommodating portion, which accommodates high concentration toner containing an external additive whose concentration is higher than that of fresh toner, where it is stirred with high concentration toner by the stirring means. Consequently, the collected residual toner and the high concentration toner are mixed in the toner accommodating portion, so that the quality of the collected residual toner is enhanced by increasing the concentration of external additive in the collected residual toner, and such quality-enhanced collected residual toner can be used for the developing. Moreover, the collected residual toner can be recycled in a device with simple configuration without providing a component for storing the collected residual toner.

In another aspect of the invention, the toner accommodating portion includes toner detection means for detecting an amount of toner accommodated by the toner accommodating portion, and means for conveying toner that is accommodated by the toner accommodating portion, to the fresh toner storage.

In accordance with this aspect of the invention, the toner accommodating portion is provided with the toner detection means for detecting an amount of toner accommodated therein, and the means for stirring and conveying collected residual toner stored in the collected residual toner storing portion to the toner accommodating portion. Consequently, toner is conveyed to the high concentration toner accommodating portion when the toner stored in the collected residual toner storage has reached a predetermined amount.

In another aspect of the invention, the fresh toner storage includes detection means for detecting an amount of toner stored in the fresh toner storage; and notification means for notifying, when the amount of toner has decreased to a predetermined amount.

In accordance with this aspect of the invention, when the detection means for detecting an amount of toner stored in the fresh toner storage detects that the amount of toner has decreased to a predetermined amount, then the user is notified of this fact. Consequently, when the toner used for developing runs short, the user can be urged to replenish fresh toner, so that a reliable image formation is possible even in the case of a toner shortage.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
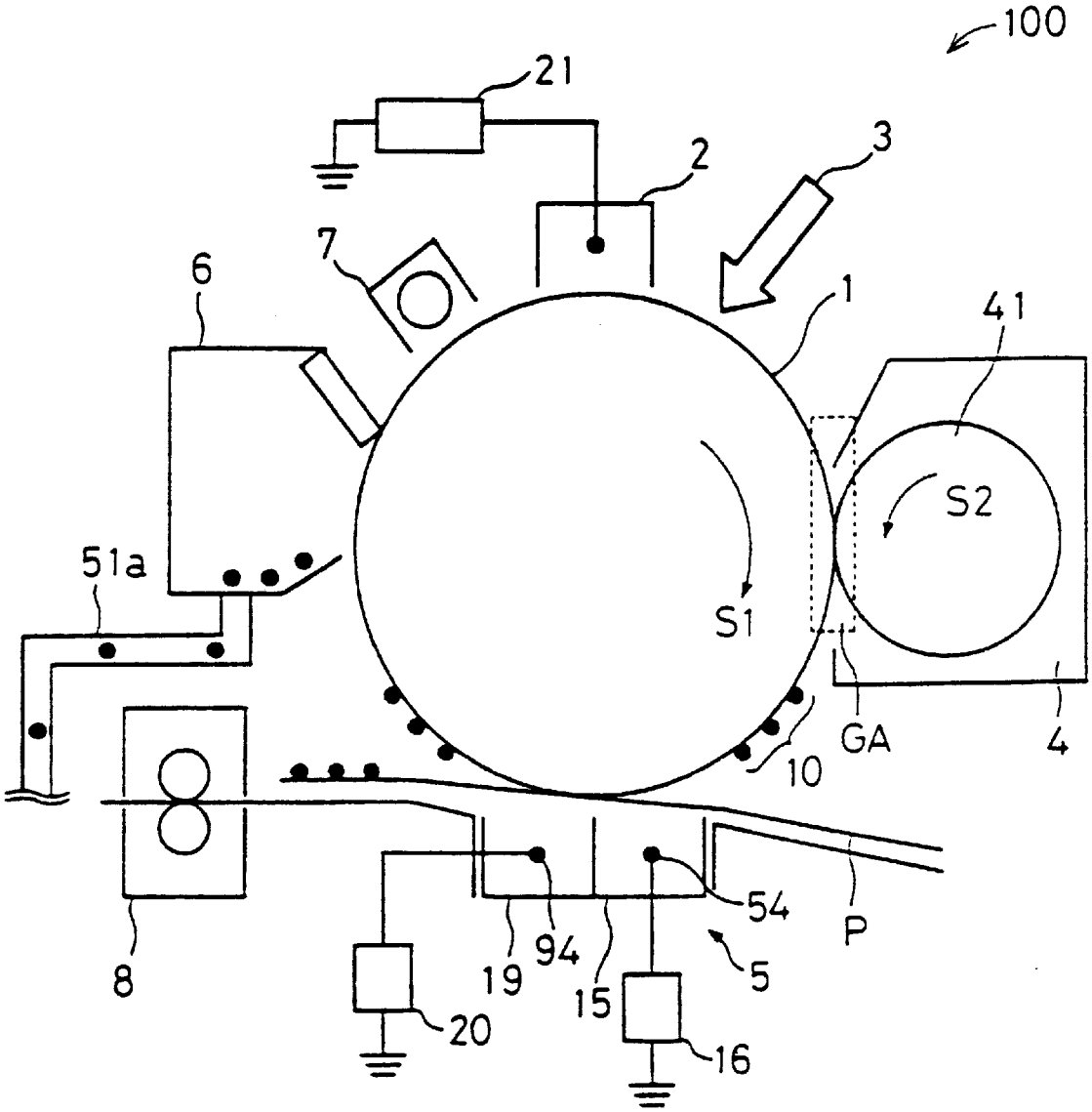
FIG. 1 shows a general configuration of an image forming portion of an image forming apparatus of an embodiment of the invention.

Now referring to the drawings, preferred embodiments of the invention are described below.

The image forming portion of an image forming apparatus in an embodiment of the present invention (also referred to as "the image forming apparatus") has the functions of forming a toner image on the photosensitive drum and transferring the toner image to a sheet by electrophotography, which includes the steps of charging, exposing, developing, transferring, cleaning, and fixing. This image forming portion can be used, for example, in a copier, a laser printer or a facsimile device.

First of all, the configuration of an image forming apparatus 100 is explained. FIG. 1 shows the general configuration of the image forming portion of the image forming apparatus 100. As shown in this drawing, the image forming apparatus 100 includes a photosensitive drum 1, a charging device 2, an exposure device (not shown in the drawing), a developing unit 4, a corona charger 5, a cleaning device 6, a discharging device 7, and a fixing device 8 including rollers. A toner recycling portion, which is a central element of the invention, is not shown in FIG. 1, but will be explained in detail below.

The photosensitive drum 1 includes a cylindrical conductive base made of a non-magnetic metal, such as aluminum, a primer layer formed on the surface of the conductive base, and a photosensitive layer formed on the primer layer, and is arranged so that it can rotate in the direction indicated by the arrow S1. The photosensitive layer is made of a carrier generation layer (also referred to as "CGL") and a carrier transfer layer (also referred to as "CTL"). The carrier transfer layer is a relatively thin layer having polycarbonate as its main component and serves as the outermost skin of the photosensitive drum 1.

The charging device 2 charges the surface of the photosensitive drum 1 uniformly negative with power supplied from a power source 21. For example, a corona charger or a contact roller charger can be used for the charging device 2.

The exposure device exposes the charged photosensitive drum 1 with laser light 3 to generate electric charges in the carrier generation layer and form an electrostatic latent image (electrostatic latent image potential), depending on the image data, on the surface of the photosensitive drum 1. That is to say, positive charges are generated in the carrier generation layer in the photosensitive drum 1 at the exposed locations, canceling the negative charge applied by the charging device 2. Consequently, the static potential at the exposed locations becomes relatively higher and forms an electrostatic latent image. A laser scanning unit (LSU) having a semiconductor laser as a light source can be used for this exposure device.

In the developing region GA, the developing unit 4 develops the latent image by supplying toner to the electrostatic latent image on the photosensitive drum 1, and forms a toner image (visible image) on the photosensitive drum 1. The developing unit 4 includes a developing roller 41, a toner reservoir for accommodating toner, a stirring roller and a power source. The developing roller 41 is provided with a dielectric layer on its surface and supplies toner 10 to the photosensitive drum while rotating in the arrow direction S2. The stirring roller stirs the toner and the carriers. The power source applies a developing bias voltage to the developing roller 41.

The corona charger 5 transfers the toner image to a sheet P that is supplied from a paper feed device (not shown in the drawings) and discharges it to fixing device 8. The corona charger 5 includes a transfer portion 15 and a peel-off portion 19.

The transfer portion 15 causes the sheet P, which has been conveyed into a predetermined transfer region, to contact the toner image on the photosensitive drum 1, transferring the toner image to the sheet P. The sheet P is conveyed into the transfer region by a conveying member (not shown in the drawings), in synchronization with the rotation of the photosensitive drum 1. That is to say, the transfer portion 15 includes a high-voltage transfer power source 16 and a discharge wire 54, and applies, with a corona discharge using the power of this power source, a positive charge (that is, a charge of opposite polarity than the polarity of the toner) to the sheet P that has been conveyed into the transfer region. Thus, the sheet P adheres to the photosensitive drum 1, and the toner image can be transferred to the sheet P. For the transfer portion 15, it is possible to use, for example, a contact roller type or a charger type discharger provided with a high-voltage power source.

The purpose of the peel-off portion 19 is to peel off the sheet P adhering to the photosensitive drum 1. The peel-off portion 19 includes a peel-off power source 20, which is a high-voltage AC power source, and a discharge wire 94. With an AC corona discharge using the power from this power source, the peel-off portion 19 applies a charge of the same polarity as the toner to the sheet P. This removes the static electricity from the sheet P, so that the sheet P peels off the photosensitive drum 1 and sinks down due to its own sturdiness and weight.

Furthermore, a peel-off tongue (not shown in the drawings) is provided downstream from the peel-off portion 19. A sharp tip of the peel-off tongue contacts the photosensitive drum 1. Sheets P that are not peeled off by removing their static electricity are effectively peeled off the photosensitive drum 1 with this peel-off tongue.

The fixing device 8 fixes the toner image on the sheet P by thermal melting. Another function of the fixing device 8 is to eject the sheet P out of the image forming apparatus.

The cleaning device 6 cleans the surface of the photosensitive drum 1 to collect toner that has remained on the photosensitive drum 1 after the transfer of the toner image. The toner that has been collected with the cleaning device 6 is conveyed through a conveyor pipe 51 a to a toner recycling portion explained below, to be recycled.

After the residual toner has been cleaned off with the cleaning device 6, the discharging device 7 removes the charge from the photosensitive drum 1, so as to electrically initialize it (to zero potential). An optical discharging lamp or a contact discharger can be used for the discharging device 7, for example.

The following is an explanation of the toner recycling portion 61 according to a first embodiment, which is a characteristic feature of the invention. The toner recycling portion 61 recovers the composition of the collected residual toner that has been collected by the cleaning device 6, and produces recycled toner.

The inventors found out that the composition of the collected residual toner that is collected by the cleaning device changes, because the external additives that have been supplemented to the toner, decrease by seceding from the toner during the image formation or becoming embedded in the toner particles, and its conveyability (flow properties) and chargeability (ability to be charged by friction) decreases. In the image forming apparatus of the invention, the quality of the toner is fundamentally recovered by adding the external additive to the collected residual toner in order to restore its composition, thereby producing recycled toner.

The basic composition of a two-component developing toner is generally as shown in Table 1.

TABLE 1

| material | Ratio in comp. | Function |
|---|---|---|
| binder resin | 80–90% | improve ability to bind, be fixed, and be charged by friction |
| pigment/dye | 5–10% | color the toner and improve ability to be charged by friction |
| charge control agent | 1–5% | improves ability to be charged by friction |
| parting agent | 0–5% | improves ability to be cleaned off and prevents fixing offset |
| external additive | 0–5% | improves ability to flow, to be charged by friction and to be cleaned off |

As shown in Table 1, the principal component of the toner is a binder resin. Apart from the binder resin, the toner contains a dye, a pigment, a charge control agent, a parting agent, an external additive and the like. The binder resin improves the toner's ability to bind, be fixed, and be charged by friction. The dye or pigment color the toner and improve the toner's ability to be charged by friction. The charge control agent improves the toner's ability to be charged by friction. The parting agent improves the toner's ability to be cleaned off, and prevents fixing offset. The external additive improves the toner's flow properties, its ability to be cleaned off, and to be charged by friction. Here, "fixing offset" means that a portion of the toner image is transferred to a roller during the fixing and is developed.

There is no limitation to the specific ingredients in the binder resin, which is the principal component of the toner, as long as they display the above-noted functions. Using a heat/press-type roller fixing device including an oil-applying device for the fixing portion of the image forming apparatus, it is suitable to use, for example, a homopolymer of styrene or its substitutions, such as polystyrene, poly-p-chlorostyrene or polyvinyltoluene; a styrene copolymer, such as styrene-p-chlorostyrene copolymer, styrene-vinyltoluene copolymer, styrene-vinylnaphthalene copolymer, styrene-acrylate copolymer, styrene-methacrylate copolymer, styrene-α-methyl chlormethacrylate copolymer, styrene-acrylonitrile copolymer, styrene-vinylmethylether copolymer, styrene-vinylethylether copolymer, styrene-vinylmethylketone copolymer, styrene-butadiene copolymer, styrene-isoprene copolymer, styrene-acrylonitrile-isoprene copolymer or styrene-acrylonitrile-indene copolymer; a vinyl resin, such as polyvinyl chloride, polyvinyl acetate or polyvinyl butyral; a phenol resin; a denatured phenol resin; a denatured maleic acid resin; a (meth)acrylic resin, such as an acrylic resin or methacrylic resin; a silicone resin; a polyester resin; a polyurethane; a polyamide resin; a furan resin; an epoxy resin; a xylene resin; a turpentine resin; a coumarone-indene resin; and other petroleum-based resins.

To prevent offset developing and toner blocking and caking using a heat/press-type roller fixing device that essentially does not apply oil, it is preferable to use, for example, the styrene copolymer mentioned above in cross-linked form or a cross-linked polyester resin. Here, "toner blocking" means that the toner hardens and its flow properties worsen, and "toner caking" means that the toner hardens and clumps together to nugget-like coagulations.

In case of a press-type roller fixing device, the toner is fixed on the paper by pressure only. Therefore it is suitable to use, for example, ethylene resins, such as polyethylene, ethylene-ethylacrylate copolymer, ethylene-vinyl acetate copolymer; polypropylene; polymethylene; polyurethane elastomer; an ionomer resin; a styrene copolymer, such as styrene-butadiene copolymer or styrene-isoprene copolymer; a linear saturated polyester; or paraffin.

The dye or pigment can be selected as appropriate in accordance with the color of the toner, so that there is no particular restriction. In the case of black toner, it is suitable to use, for example, pigments such as carbon black, aniline black, acetylene black, phthalocyanine blue or indanthrene blue, or dyes such as azo dye, anthraquinone dye, xanthene dye or methine dye.

There is no particular restriction regarding the charge control agent, and for positive charging, it is possible to use, for example, a salt structure combining cations with large ion radius such as quaternary ammonium and anions such as halogens For negative charging, it is possible to use, for example, a salt structure combining anions of large ion radius with ligands bonded to a metal atom and alkali metal anions.

There is no particular restriction regarding the parting agent, and it is suitable to use, for example, an ethylene-propylene copolymer, such as low molecular weight polyethylene, low molecular weight polypropylene or low molecular weight ethylene-polypropylene copolymer; or a wax, such as a microcrystalline wax, carnauba wax, sazol wax or paraffin wax.

There is no particular restriction regarding the external additive, but it is possible to use silica (silicon oxide: $SiO_2$) powder, alumina (aluminum oxide: $Al_2O_3$) powder or titania (titanium oxide: $TiO_2$) powder. Among these, it is preferable to use silica powder. It is particularly preferable to use a hydrophobic external additive. This is because a hydrophobic external additive can suppress environmental variations of the charge amount of, for example, the developing agent better than hydrophilic materials. Especially under high temperatures and high pressures, the charge amount of the toner decreases and the toner easily scatters and covers the document, so that it is very desirable to make the toner hydrophobic. Consequently, when selecting for example silica powder as the external additive, it is preferable to use a silica powder with high hydrophobicity of, for example, at least 40% hydrophobization degree. It is even more preferable to use a silica powder with at least 60% hydrophobization degree.

As mentioned above, it was previously not known that the decrease of the collected residual toner's flow properties and its ability to be charged by friction is originated by the reduction of the external additive in the toner composition. The external additive, such as silica powder, is removed from the toner or becomes embedded in the toner during the steps of developing, transferring and cleaning the toner, so that the amount of external additive contained in the toner is reduced. Therefore, if the residual toner is recycled as it is, its developing properties worsen and improper cleaning may occur. In particular, the amount of silica powder contained in residual toner that is collected after the cleaning step drops to about ⅕ to ⅘ of that of fresh toner. Usually, the amount of external additive contained in, such as silica powder, contained in fresh toner is about 0.5% by weight of the toner weight.

In this embodiment, 0.1 to 0.4% by weight of external additive are added at a later stage in order to restore the amount of external additive in the collected residual toner to the level in fresh toner, which is about 0.5% by weight. Depending on the type of toner used, together with the a one-component or two-component developing agent, the external additive accounts for 0.3 to 0.7% by weight with respect of the toner weight. Therefore, when the external additive amount before use is 0.5% by weight, the collected residual toner can be used without problems, if it contains 0.3 to 0.7% by weight external additive after the external additive has been added. That is to say, in accordance with the invention, the tolerance for differences of external additive added at later stage is ±40%, preferably ±10%, with respect to the amount of external additive in fresh toner.

When Y[% by weight] is the weight ratio of external additive contained in the fresh toner, and X[% by weight] is the weight ratio of external additive contained in the collected residual toner, then the amount Z[% by weight] of external additive to be supplemented to the collected residual toner so that the amount of external additive is within ±10% of that included in the fresh toner is given by:

$$Y(1-0.1) \leqq X+Z \leqq Y(1+0.1)$$

$$0.9Y-X \leqq Z \leqq 1.1Y-X \quad (1)$$

Consequently, if an amount of external additive in the range given by equation (1) is supplied, then a recycled toner of high quality can be produced.

Table 2 shows specific examples of external additives used in the invention. However, the external additives of the invention are not limited to these examples. The following external additives are all by Nippon Aerosol K.K.

TABLE 2

| external additive | product name | Particle size (nm) | spec. weight ($g/cm^3$) |
|---|---|---|---|
| silica ($SiO_2$) | R972 | 16 | 0.05 |

TABLE 2-continued

| external additive | product name | Particle size (nm) | spec. weight ($g/cm^3$) |
|---|---|---|---|
| | R974 | 12 | 0.05 |
| | RX200 | 12 | 0.05 |
| alumina ($Al_2O_3$) | RFY-C | 13 | 0.05 |
| titania ($TiO_2$) | T805 | 21 | 0.2 |

Conventional techniques for adding silica powder or the like as external additive to fresh toner are disclosed in Japanese Unexamined Patent Publications JP-A 5-216267 (1993) and JP-A 8-185101 (1996), for example. However, these techniques relate to the manufacture of fresh toner, and are not suitable for recycle of residual toner, unlike the invention.

Figure 2:
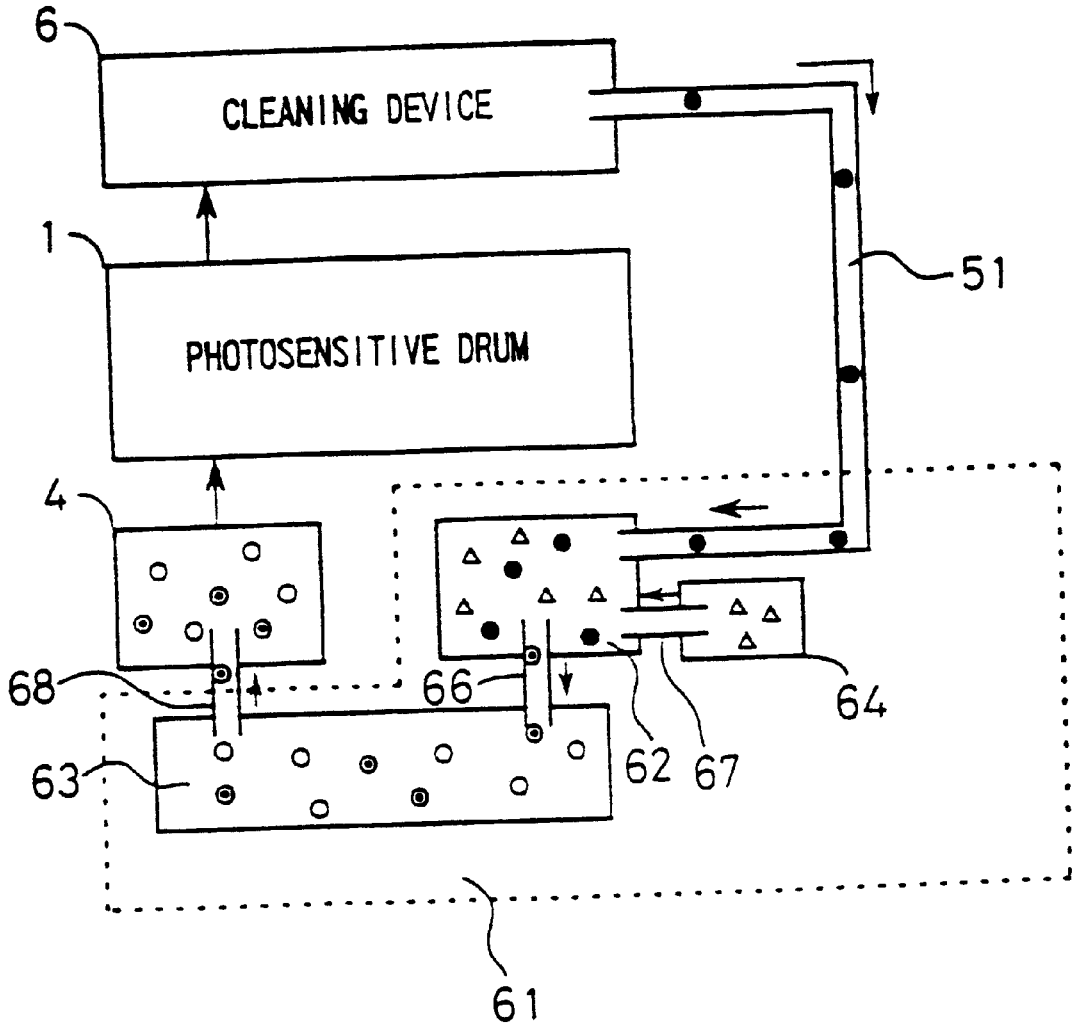
FIG. 2 is a block diagram illustrating the general configuration of the image forming portion of the image forming apparatus of this embodiment of the invention.

FIG. 2 is a block diagram showing a conceptional configuration for recycling residual toner in the image forming portion of the image forming apparatus of the embodiment of the invention. This image forming apparatus is provided with a toner recycling portion 61, which produces recycled toner by adding external additive to the residual toner that has been collected with the cleaning device 6 and restoring its composition. The toner recycling portion 61 has the functions to add external additive to the collected residual toner to produce recycled toner, then mix the recycled toner with fresh toner (fresh toner), and supply the mixture to the developing unit 4.

The toner recycling portion 61 includes a collected residual toner storage 62, a fresh toner storage 63, and an external additive cartridge 64. A conveyance path 51 connects the cleaning device 6 with the collected residual toner storage 62. Also, a conveyance path 67 connects the collected residual toner storage 62 with the external additive cartridge 64. In addition, a conveyance path 66 connects the collected residual toner storage 62 with the fresh toner storage 63. Moreover, a conveyance path 68 connects the fresh toner storage 63 with the developing unit 4.

The external additive cartridge 64 stores external additive, which it supplies to the collected residual toner storage 62 through the conveyance path 67.

The collected residual toner storage 62 accumulates residual toner collected with the cleaning device 6 and conveyed to it through the conveyance path 51. Then, the collected residual toner and the external additive supplied from the external additive cartridge 64 are mixed while being stirred inside the collected residual toner storage 62, thereby producing recycled toner. This recycled toner has approximately the same conveyability and chargeability as fresh toner.

The fresh toner storage 63 stores fresh toner, as well as recycled toner, which has been produced in the collected residual toner storage 62 and is conveyed to the fresh toner storage 63 through the conveyance path 66. The fresh toner and the recycled toner are supplied to the developing unit 4 through the conveyance path 68.

With this configuration, when the amount of toner in the developing unit 4 drops below a predetermined amount, toner is supplied to the developing unit 4 from the fresh toner storage 63 through the conveyance path 68. And when the amount of collected residual toner that has been conveyed to the collected residual toner storage 62 reaches a first predetermined amount A, then external additive is supplied to the collected residual toner storage 62 from the external additive cartridge 64 through the conveyance path 67. Moreover, when the amount of collected residual toner that has been conveyed to the collected residual toner storage 62 reaches a second predetermined amount B without external additive being supplied from the external additive cartridge 64, then the image formation is stopped.

Here, the first and second predetermined amounts A and B are indicative of the range of the amount of collected residual toner that corresponds to the amount of external additive in the external additive cartridge 64. That is to say, if the amount of collected residual toner is between the first predetermined amount A and the second predetermined amount B, then recycled toner of suitable composition can be produced easily by mixing with the external additive in the external additive cartridge 64. In other words, if the amount of collected residual toner is outside the range of first predetermined amount A to second predetermined amount B, then it is not possible to produce a high quality recycled toner, because the composition of the recycled toner cannot be recovered satisfactorily even when adding the external additive in the external additive cartridge 64. As shown in equation (1), if the first predetermined amount A is taken as $0.9Y-X$ and the second predetermined amount B is taken as $1.1Y-X$, then the amount of external additive supplemented to the collected residual toner can be set within a range of ±10% of the amount of external additive contained in fresh toner.

When the external additive is supplied from the external additive cartridge 64 through the conveyance path 67 to the collected residual toner storage 62, it is stirred inside the collected residual toner storage 62, recycled toner is produced, and the recycled toner is supplied through the conveyance path 66 to the fresh toner storage 63.

Figure 3:
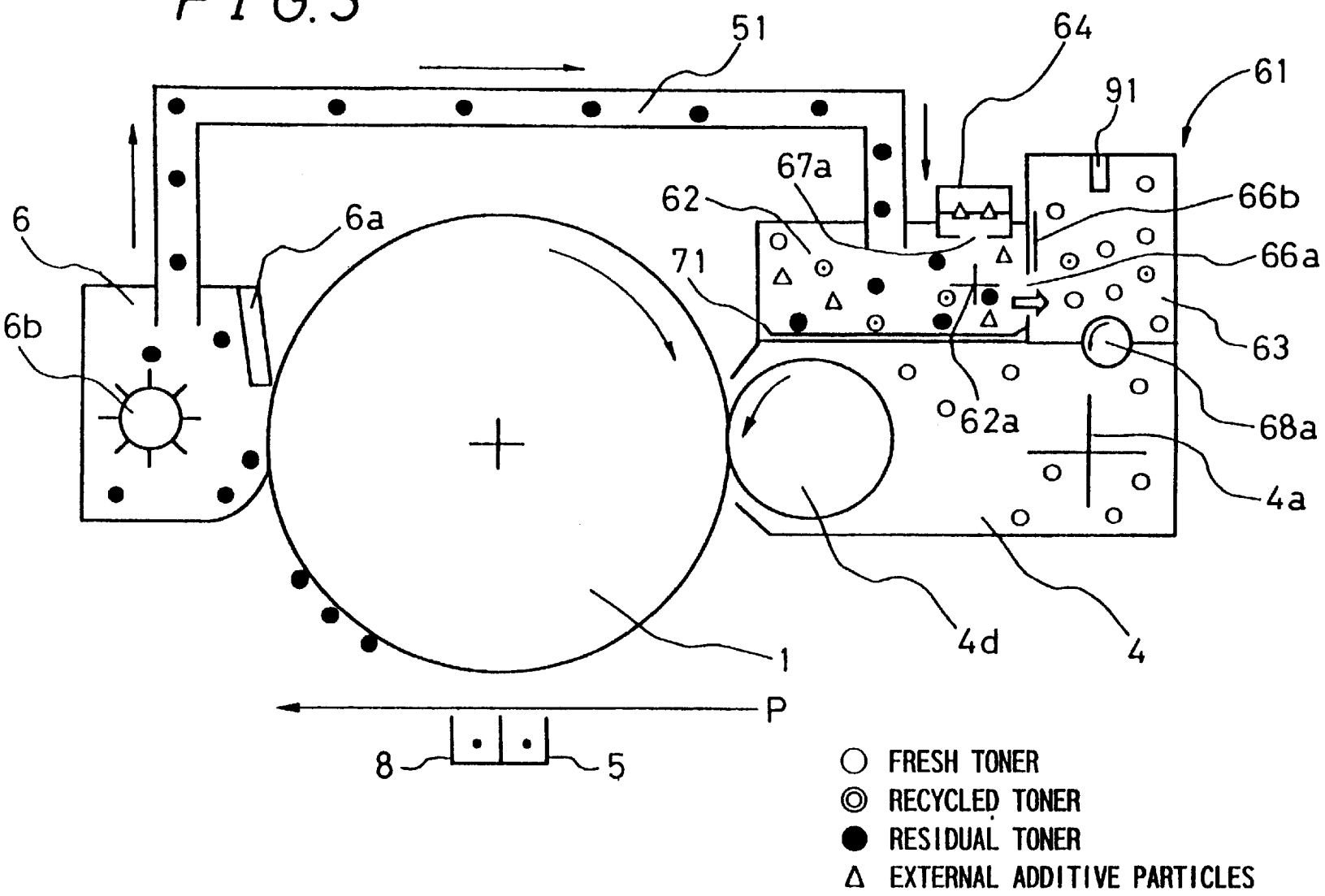
FIG. 3 shows a general configuration for recycling residual toner.

The following is a more detailed explanation of this configuration, with reference to FIG. 3. FIG. 3 illustrates the general configuration of the image forming portion of an image forming apparatus in accordance with an embodiment of the invention. The developing unit 4, a transfer device 5, a peel-off device 8, and the cleaning device 6 are arranged in opposition to the circumference of the photosensitive drum 1. Moreover, the toner recycling portion 61 is provided in the upper portion of the developing unit 4.

The developing unit 4 includes a stirring screw 4*a* for stirring the toner and a developing roller 4*d* for supplying toner to the photosensitive drum 1.

The cleaning device 6 includes a cleaning blade 6*a* for scraping off toner that has remained on the surface of the photosensitive drum 1 and collecting this residual toner, and a stirring screw 6*b* for stirring the collected residual toner to prevent the collected residual toner from coagulating.

The toner recycling portion 61 is made of the collected residual toner storage 62, the fresh toner storage 63, and the external additive cartridge 64. The external additive cartridge 64 is located at the top of the collected residual toner storage 62, whereas the fresh toner storage 63 is provided at a location adjacent to a side wall of the collected residual toner storage 62. The fresh toner storage 63 can also be provided at a location adjacent to a lower wall of the collected residual toner storage 62.

The conveyance path 51 connects the collected residual toner storage 62 with the cleaning device 6, and residual toner that has been collected in the cleaning device 6 is conveyed to the collected residual toner storage 62 with a screw (not shown in the drawings) provided in the conveyance path 51. An aperture portion 67*a* connects the external additive cartridge 64 with the collected residual toner storage 62. An aperture portion 66*a* connects the collected residual toner storage 62 with the fresh toner storage 63. The aperture portion 66*a* is provided with a partition plate 66*b*, which can be opened and closed with an open and close device (not shown in the drawings). A toner supply roller 68*a* connects the fresh toner storage 63 with the developing unit 4.

External additive is stored inside the external additive cartridge 64. The collected residual toner storage 62 is provided with a stirring screw 62*a* and a collected residual toner sensor 71. The stirring screw 62*a* is stirring means for stirring external additive that has been supplied from the external additive cartridge 64 and collected residual toner that has been conveyed through the conveyance path 51. The toner sensor 71 is collected residual toner detection means for detecting the amount of toner that has accumulated in the collected residual toner storage 62. This toner sensor 71 measures the weight of the collected residual toner that has accumulated in the collected residual toner storage 62, thereby detecting the amount of collected residual toner. The fresh toner storage 63 is provided with a fresh toner sensor 91, which is fresh toner detection means for detecting the amount of toner that has accumulated in the fresh toner storage 63. There is no particular restriction with regard to the fresh toner sensor 91, as long as it can detect a toner amount, and it is suitable to use, for example, an optical reflection sensor, an ultrasonic sensor, or a weight sensor.

Collected residual toner that has been supplied to the developing roller 4*d* of the developing unit 4 to the photosensitive drum 1 and has remained without being transferred by the transfer device 5 to the transfer material P is scraped off with the cleaning blade 6*a* of the cleaning device 6 and is collected. The collected residual toner is stirred with the stirring screw 6*b*, so that it does not coagulate. Then, the collected residual toner is conveyed by a screw (not shown in the drawings) in the conveyance path 51 to the collected residual toner storage 62 of the toner recycling portion 61. If the collected residual toner sensor 71 detects that the amount of the collected residual toner in the collected residual toner storage 62 is in the range between the first predetermined amount A and the second predetermined amount B, then external additive is supplied from the external additive cartridge. The supplied external additive and the collected residual toner are mixed while being stirred with the stirring screw 62*a* to produce recycled toner. After stirring for a predetermined time, the open and close device (not shown in the drawings) brings the partition plate 66*b* into the open position, and the recycled toner is supplied to the fresh toner storage. The fresh toner and the recycled toner that have accumulated in the fresh toner storage 63 are supplied with the toner supply roller 68*a* to the developing unit 4 and mixed while being stirred with the stirring screw 4*a*. Then, the developing roller 4*d* supplies the fresh toner and the recycled toner to the surface of the photosensitive drum 1.

Figure 4B:
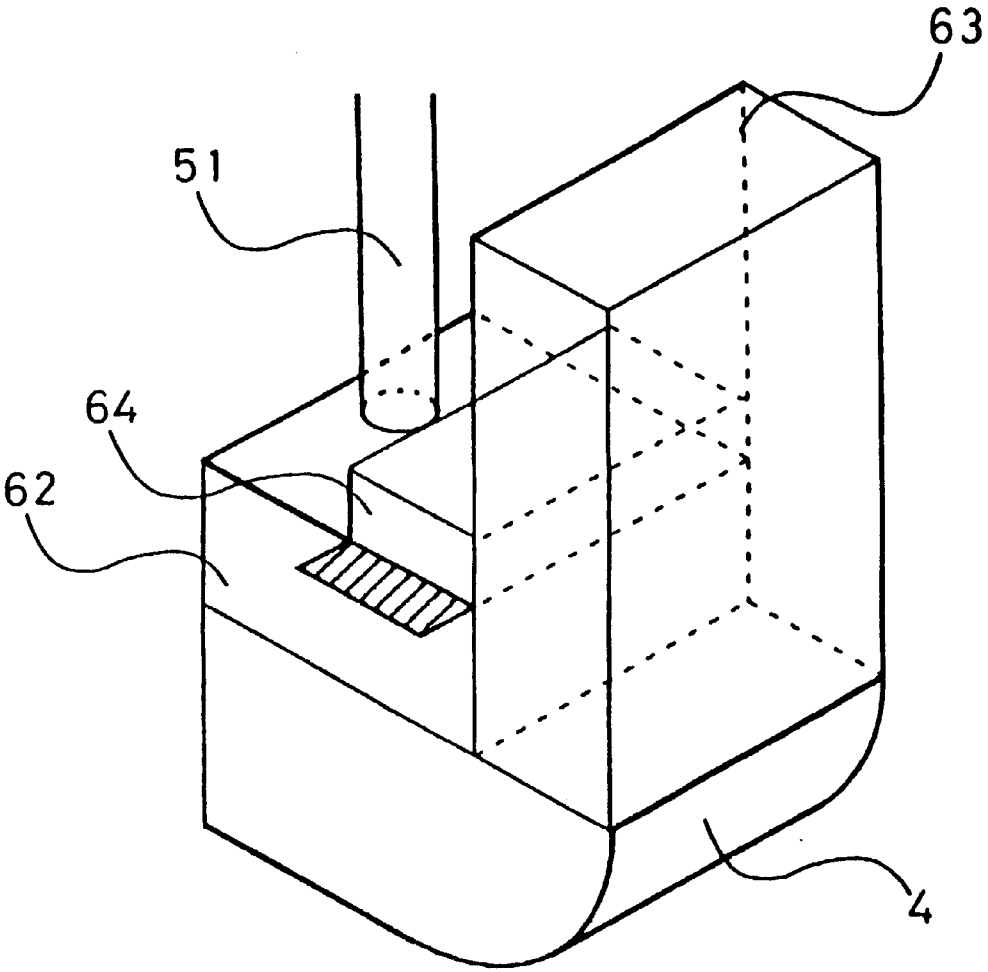
FIGS. 4A and 4B show an outside appearance of the toner recycling portion and an external additive cartridge.
Figure 4A:
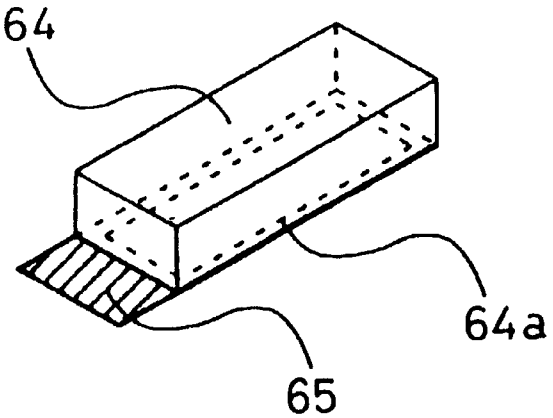

FIGS. 4A and 4B show a general configuration of the developing unit 4 and the toner recycling portion 61 and the outer appearance of the external additive cartridge 64. The developing unit 4 and the toner recycling portion 61 are box-shaped, and the fresh toner storage 63 is provided adjacent to a side wall of the collected residual toner storage 62. Moreover, the collected residual toner storage 62 and the fresh toner storage 63 are provided adjacent to a top wall of the developing unit 4. A portion of the top wall of the collected residual toner storage 62 is provided with a tubular conveyance path 51, and the external additive cartridge 64 is provided detachably adjacent to the top wall of the collected residual toner storage 62.

The external additive cartridge 64 stores a predetermined amount of external additive, and the bottom of the external additive cartridge 64 is provided with an aperture portion 64*a*. This aperture portion 64*a* is sealed by a heat seal 65, which can be easily peeled off by pulling a portion projecting outward. The external additive cartridge 64 is attached with the aperture portion 64*a* arranged in opposition to an aperture portion 67*a* in the top wall of the collected residual toner storage 62. In this situation, the heat seal 65 is peeled off by pulling the portion projecting outward, whereby the external additive in the external additive cartridge 64 is supplied to the collected residual toner storage 62 through the aperture portion 64*a* and the aperture portion 67*a*.

After supplying the recycled toner, the external additive cartridge 64 can be exchanged with a new cartridge, so that another addition of external additive to the collected residual toner can immediately follow.

Figure 5A:
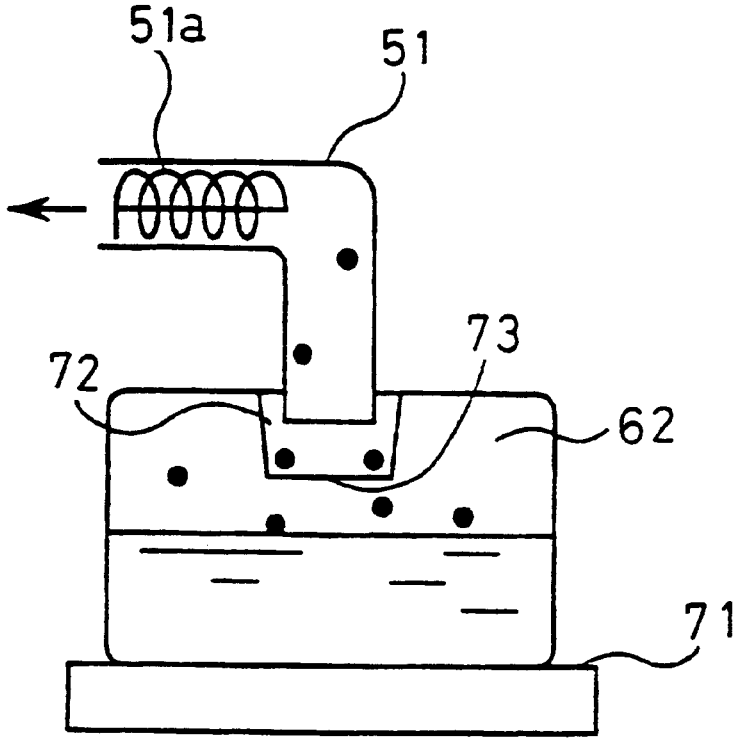
FIGS. 5A and 5B show the configuration of a foreign matter eliminating means.
Figure 5B:
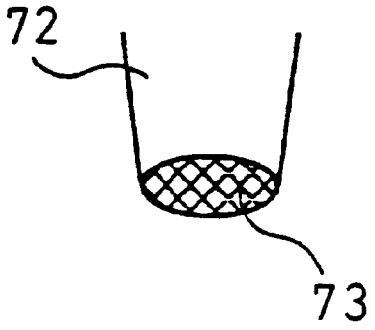

FIGS. 5A and 5B show the configuration of the junction portion between the collected residual toner storage 62 and the conveyance path 51. As shown in FIG. 5A, means 72 for eliminating foreign matter, which separates and eliminates paper particles or coagulated toner, is provided at the conveyor port through which collected residual toner is conveyed from the conveyance path 51 to the collected residual toner storage 62. As shown in FIG. 5B, the foreign matter eliminating means 72 is cup-shaped with a bottom portion made of a mesh 73, and it is detachably attached to the collected residual toner storage 62. With this structure, separated and eliminated foreign matter can be removed easily. It is also possible to compose the entirety of the foreign matter eliminating means 72 of a mesh.

For the size of the holes in the mesh 73, a range of at least 20 $\mu$m and at most 200 $\mu$m, which is larger than the particle size of the collected residual toner passing through it and smaller than the particle size of foreign matter to be eliminated, is preferable. The particle size of the toner is usually 5 to 15 $\mu$m, whereas the minimum particle size of foreign matter is 200 $\mu$m, so that setting the size of the holes in the mesh 73 to this range, foreign matter or the like does not pass through the mesh so that it can be separated and eliminated reliably, and clogging of the mesh with collected residual toner can be avoided. Moreover, impeding the passage of relatively small toner coagulations of about 60 to 180 $\mu$m improves the image quality even further, so that it is even more preferable to set the size of the holes in the mesh 73 to a range of 20 to 50 $\mu$m.

Figure 6:
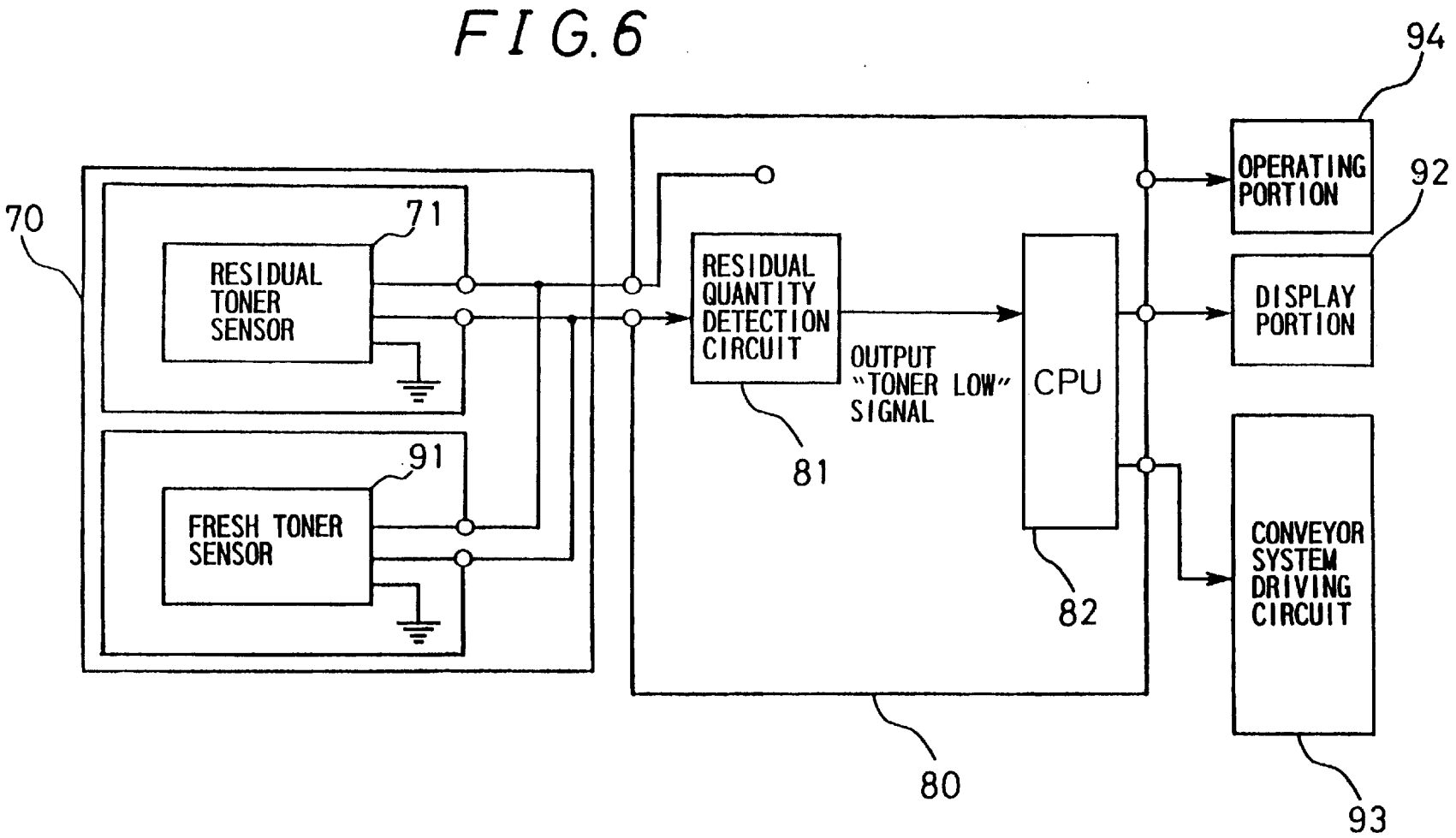
FIG. 6 is a block diagram showing the configuration of a control system.

The following is an explanation of the toner recycling in this image forming apparatus. FIG. 6 is a block diagram showing the configuration of a control system for controlling the operation of the image forming apparatus. This control system includes a control portion 80, a toner detector 70, a display portion 92 serving as notification means, a conveyor system driving circuit 93, and an operating portion 94.

The control portion 80 includes a residual quantity detection circuit 81 and a CPU 82 provided in a main unit of the image forming apparatus. The toner detector 70 includes a collected residual toner sensor 71 and a fresh toner sensor 91.

The CPU 82 is connected to the residual quantity detection circuit 81, the display portion 92, the conveyor system driving circuit 93 and the operating portion 94. The residual quantity detection circuit 81 is connected to the collected residual toner sensor 71 and the fresh toner sensor 91.

A signal corresponding to the amount of toner in the collected residual toner storage 62 detected with the collected residual toner sensor 71 and a signal corresponding to the amount of toner in the fresh toner storage 63 detected with the fresh toner sensor 91 are sent to the residual quantity detection circuit 81.

Based on the signals sent from the collected residual toner sensor 71 and the fresh toner sensor 91, the residual quantity detection circuit 81 determines the amounts of toner in the collected residual toner storage 62 and the fresh toner storage 63, and outputs a signal corresponding to these amounts to the CPU 82.

Based on the signal sent from the residual quantity detection circuit 81, the CPU 82 controls the display portion 92 and the conveyor system driving circuit 93. The CPU 82 also detects operating signals that the user inputs with operating buttons provided in the operating portion 94.

The display portion 92 is a liquid crystal display (not shown in the drawings) on the image forming apparatus. It should be noted that the liquid crystal display is given only as an example for a display portion 92 serving as notification means, and it is also possible to use notifications means notifying the user by a voice synthesizer or a buzzer.

Figure 7:
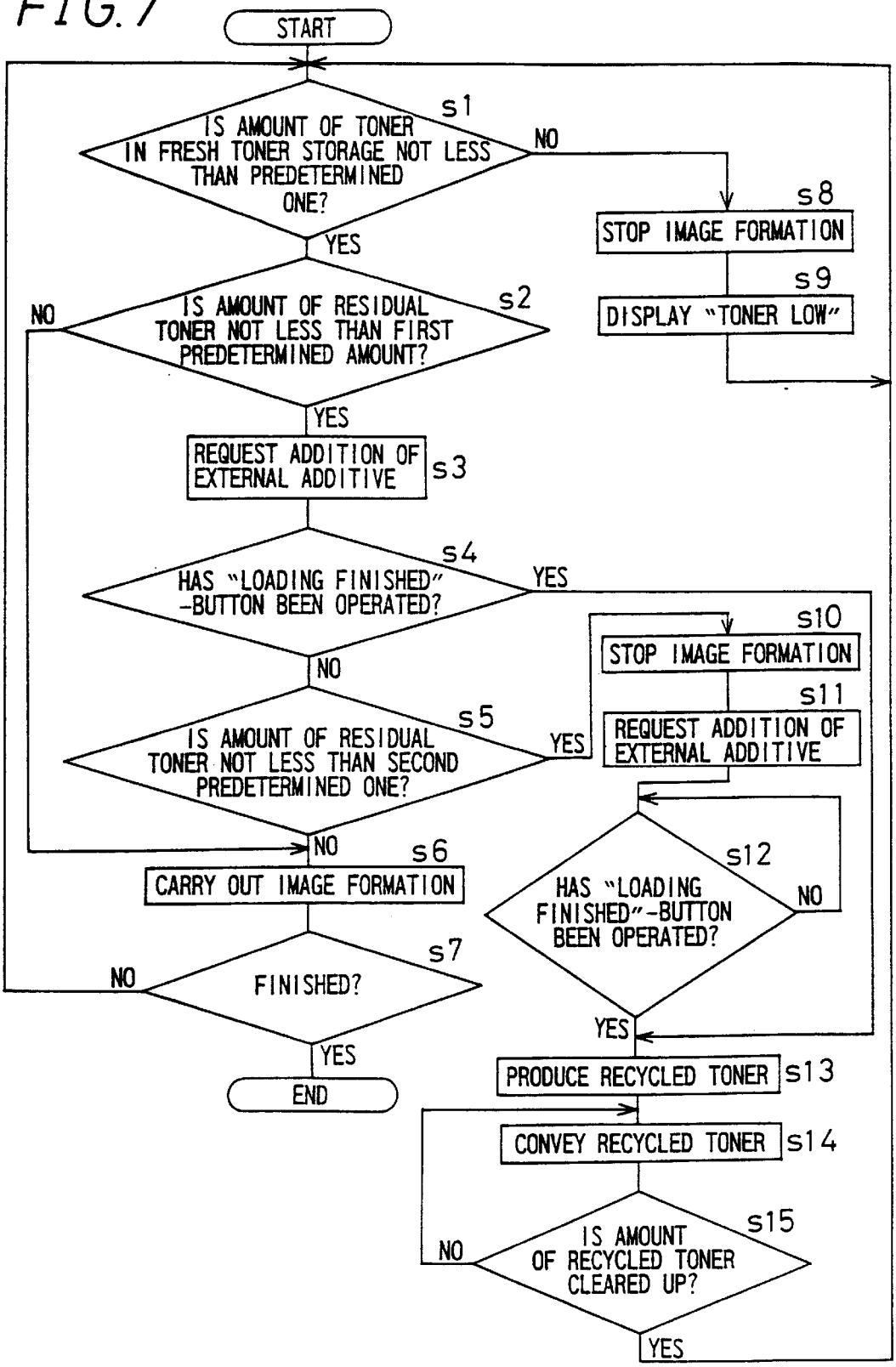
FIG. 7 is a flowchart illustrating toner recycling procedure.

FIG. 7 is a flowchart illustrating the procedure of the toner recycling process in this image forming apparatus. When the user operates a start button (not shown in the drawings) provided on the operating portion 94 of the image forming apparatus to start the image formation, first of all the CPU 82 detects the amount of toner in the fresh toner storage 63 with the fresh toner sensor 91. From the result of this detection, it is determined, whether the toner amount in the fresh toner storage 63 is equal to or higher than a predetermined amount (s1). If the CPU 82 determines that the amount of toner in the fresh toner storage 63 is smaller than this predetermined amount, then it causes the conveyor system driving circuit 93 to stop image formation until the user has replenished fresh toner (s8). Then, the fact that the replenishing of fresh toner is necessary is displayed on the display portion 92 (s9).

On the other hand, if the amount of toner in the fresh toner storage 63 is equal to or higher than this predetermined amount, then the CPU 82 detects the amount of toner in the collected residual toner storage 62 with the collected residual toner sensor 71. From the result of this detection, it is determined, whether the toner amount in the collected residual toner storage 62 is equal to or higher than a first predetermined amount A (s2).

If the CPU 82 determines that the amount of toner in the collected residual toner storage 62 is smaller than the first predetermined amount A, then it executes the image formation (s6). If the amount of toner in the collected residual toner storage 62 is equal to or higher than the first predetermined amount A, then the CPU 82 displays a message on the display portion 92 that it is time to produce recycled toner. The user peels off the heat seal 65 sealing the external additive cartridge 64 to load the external additive into the collected residual toner storage 62 (s3), and then operates a "loading finished"-button on the operating portion 94 (s4). The CPU 82 decides that the external additive has been loaded into the collected residual toner storage 62 and the external additive and the collected residual toner are mixed while being stirred with the stirring screw in the collected residual toner storage 62, thereby producing recycled toner (s13).

After stirring for a predetermined time, the CPU 82 activates the open and close device (not shown in the drawings) and the partition plate 66*b* arranged between the collected residual toner storage 62 and the fresh toner storage 63 is opened. Then, the recycled toner in the collected residual toner storage 62 is replenished to the fresh toner storage 63 (s14). When the recycled toner has been supplied to the fresh toner storage 63, and the collected residual toner sensor 71 detects that the recycled toner in the collected residual toner storage 62 is approximately cleared up (s15), then the CPU 82 returns the partition plate to the closed position by activating the open and close device (not shown in the drawings), finishing the supply of recycled toner to the fresh toner storage 63, and returns to s1 in the process.

If the external additive is supplemented while the external additive is in the range between the first predetermined amount A and the second predetermined amount B, then it is possible to produce recycled toner of high quality. Consequently, when the external additive is not supplemented and the "loading finished"-button (not shown in the drawings) on the operating portion 94 is not operated even though the display portion 92 has displayed the message that it is time to produce recycled toner (s4), then the CPU 82 detects the toner amount in the collected residual toner storage 62 with the collected residual toner sensor, and decides whether the toner amount is not less than a second predetermined amount B (B<=A) (s5). If the collected residual toner amount is less than the second predetermined amount B, then the image formation is continued (s6); finished query follows (s7).

On the other hand, if the collected residual toner amount has reached the second predetermined amount B, the CPU 82 stops the image formation with the conveyor system driving circuit 93 of the image forming apparatus (s10) and displays on the display portion 92 the message that fresh toner has to be replenished (s11).

After the user has peeled off the heat seal 65 of the external additive cartridge 64 and supplied the external additive to the collected residual toner storage 62, the user operates the "loading finished"-button (not shown in the drawings) provided on the operating portion 94. The CPU 82 decides that external additive has been loaded into the collected residual toner storage 62 and performs the above-described steps s13 to s15.

If the "loading finished"-button (not shown in the drawings) on the operating portion 94 is not operated after replenishing the external additive (s12), then the CPU 82 decides that external additive has not been supplemented, and displays the message on the display portion 92 that it is necessary to replenish fresh toner (s11) while disrupting the image formation.

In this manner, the invention concentrates on the fact that the reason for the functional deterioration of the collected residual toner is the change of the composition of the toner due to a reduction of the external additive. With that in mind, the quality of the changed composition is restored by adding external additive to the collected residual toner in the toner recycling portion 61 of the invention to fundamentally restore the toner, so that a recycled toner of high quality can be obtained. Thus, with the image forming apparatus of the invention, it is possible to suppress the covering of the document with toner and the scattering of toner, and to output images with consistently proper image density.

The following is an explanation of the toner recycling portion 161 in a second embodiment of the image forming apparatus 100 of the invention. In the toner recycling portion 161 in the second embodiment of the image forming apparatus 100, the quality of the toner is fundamentally recovered by restoring the composition of the collected residual toner. That is to say, the concentration of the external additive in the toner is stabilized by mixing with the collected residual toner while stirring, in which the external additive concentration has decreased, toner with an external additive concentration that is higher than that of fresh toner (also referred to as "high concentration toner" in the following).

The following is an explanation of the amount of the external additive that is mixed into the high concentration toner to be mixed when producing recycled toner. The external additives that can be used in this image forming apparatus are the same as the ones shown in Table 2 above.

Generally, the external additive concentration in the fresh toner is about 0.5% by weight (relative to the toner weight). On the other hand, the amount of the external additive included in the collected residual toner decreases to about ⅕ to ⅘ of that of fresh toner. Therefore, to return the amount of external additive contained in the recycled toner to the same value as that of fresh toner, it is preferable that the amount of external additive supplemented to the collected residual toner is about 0.1 to 0.4% by weight of the collected residual toner.

It should be noted that it is not necessary to make the external additive concentration in the recycled toner exactly the same as that of fresh toner. That is to say, it is preferable that the external additive concentration of the recycled toner is within a range of ±40%, more preferably ±10%, of the external additive concentration of fresh toner.

Consequently, if the external additive concentration of the fresh toner is, for example, 0.5% by weight, it is preferable that the external additive concentration in the recycled toner is in the range of 0.3 to 0.7% by weight, more preferably 0.45 to 0.55% by weight.

Thus, when Y is the weight ratio of external additive contained in the fresh toner, and X is the weight ratio of external additive contained in the collected residual toner, then the weight ratio A of external additive to be supplemented to the collected residual toner so that the amount of external additive is within ±10% of that contained in fresh toner is given by:

$$Y(1-0.1)<=X+A<=Y(1+0.1)$$

$$0.9Y-X<=A<=1.1Y-X \quad (2)$$

If an amount of external additive in the range given by equation (2) is replenished, then a recycled toner of high quality can be produced. Consequently, to attain the same effect by mixing high concentration toner and residual toner without deteriorating the quality of the high concentration toner as when adding external additive to the toner, it is appropriate to add the weight ratio Y of external additive contained in fresh fresh toner to each side of equation (2). This yields the following equation:

$$0.9Y-X+Y<=A+Y<=1.1Y-X+Y$$

when the external additive concentration of the high concentration toner is taken as Z, the external additive concentration Z is:

$$Z=A+Y$$

therefore $$1.9Y-X<=Z<=2.1Y-X \quad (3)$$

When, for example, the external additive concentration of fresh toner is 0.5% by weight and 100 g of toner is collected in which the amount of external additive has decreased to 0.25% by weight, in order to obtain recycled toner having an external additive concentration within a range of ±10% of the external additive concentration of fresh toner, it is necessary from equation (3) to mix to the 100 g collected toner, 100 g high concentration toner containing the external additive in a weight ratio of:

$$0.7\leftarrow Z\leftarrow 0.8 \quad (4)$$

In the image forming apparatus of this embodiment, the above-noted high concentration toner is used. Conventional techniques for adding silica powder or the like as external additive to fresh toner are disclosed in JP-A 5-216267 and JP-A 8-185101, for example. However, these techniques relate to the manufacture of fresh toner, and are not suitable for the recycle of residual toner.

Figure 8:
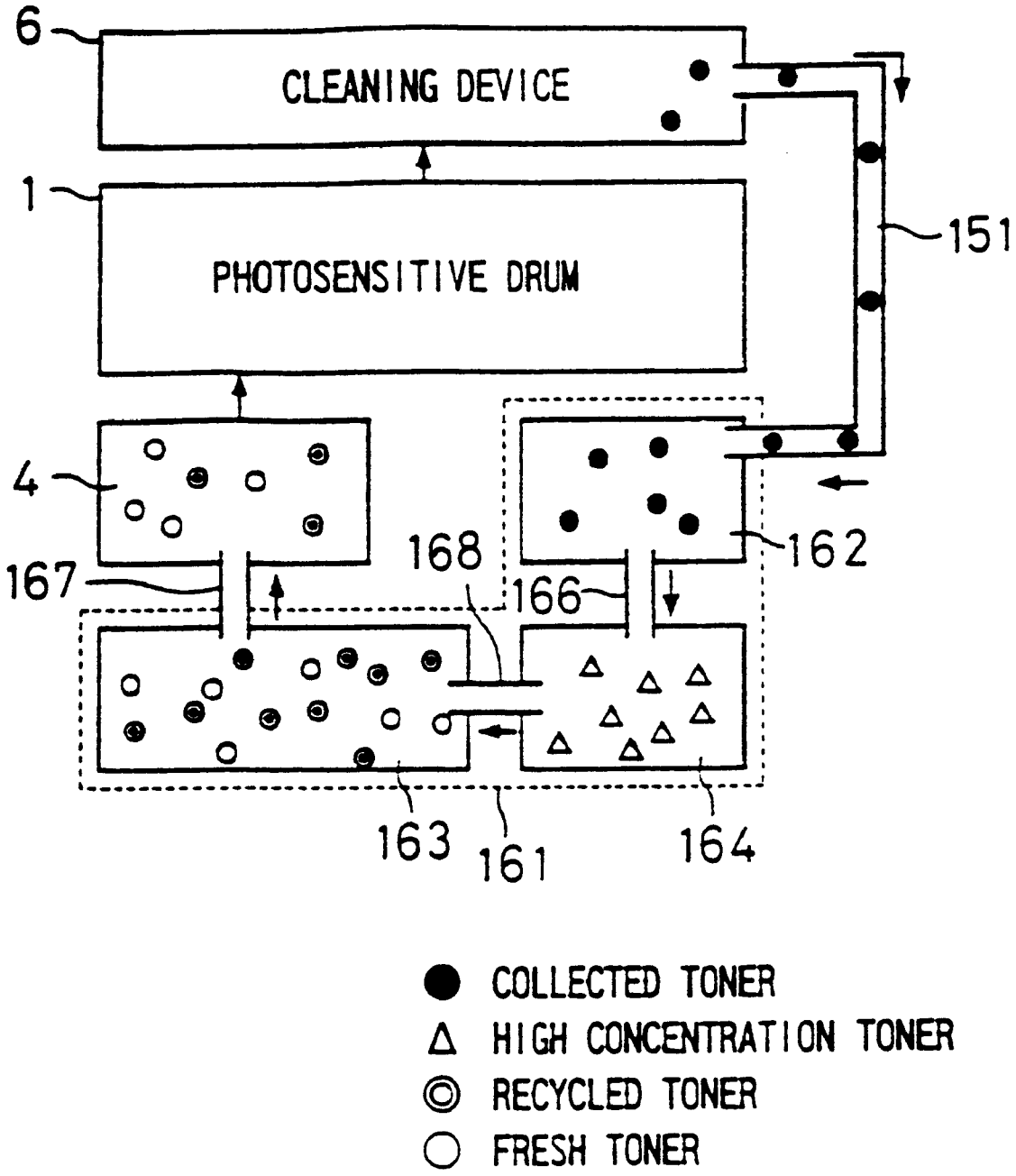
FIG. 8 is a block diagram showing a conceptional configuration for recycling toner in an image forming apparatus of the invention.

Referring to FIG. 8, the following is an explanation of the general configuration for mixing high concentration toner with the collected residual toner while stirring as described above. FIG. 8 is a block diagram showing the general configuration for the recycling of toner in this image forming apparatus.

In this image forming apparatus, the residual toner collected with the cleaning device 6 is conveyed to the toner recycling portion 161, and recycled toner is produced by mixing high concentration toner with the collected residual toner in the toner recycling portion 161 while stirring. Then, mixed toner is produced by mixing the recycled toner and fresh toner while stirring, and this mixed toner is supplied to the developing unit 4. Then, the mixed toner is supplied from the developing unit 4 to the electrostatic latent image formed on the photosensitive drum 1.

The toner recycling portion 161 includes a collected residual toner storage 162, a fresh toner storage 163, and a high concentration toner accommodating portion 164. The cleaning device 6 and the collected residual toner storage 162 are connected by a conveyance path 151. The collected residual toner storage 162 and the high concentration toner accommodating portion 164 are connected by a conveyance path 166. The high concentration toner accommodating portion 164 and the fresh toner storage 163 are connected by a conveyance path 168. The fresh toner storage 163 and the developing unit 4 are connected by a conveyance path 167.

The collected residual toner storage 162 is the place where residual toner that has been collected by the cleaning device 6 and conveyed through the conveyance path 151 is accumulated.

The high concentration toner accommodating portion 164 is the place where the fresh high concentration toner with the external additive concentration as defined in equation (3) is accommodated. Moreover, residual toner that has been accumulated in the collected residual toner storage 162 is conveyed to the high concentration toner accommodating portion 164 through the conveyance path 166. Then, collected residual toner and high concentration toner are stirred and mixed to produce recycled toner. This recycled toner has approximately the same conveyability and chargeability as fresh toner.

The fresh toner storage 163 is the place where fresh toner is accumulated. It is also the place to produce mixed toner by mixing recycled toner that has been conveyed to it through the conveyance path 168 and the fresh toner while stirring. This mixed toner is conveyed through the conveyance path 167 to the developing unit 4. Then, the mixed toner is supplied from the developing unit 4 to the photosensitive drum 1.

Figure 9:
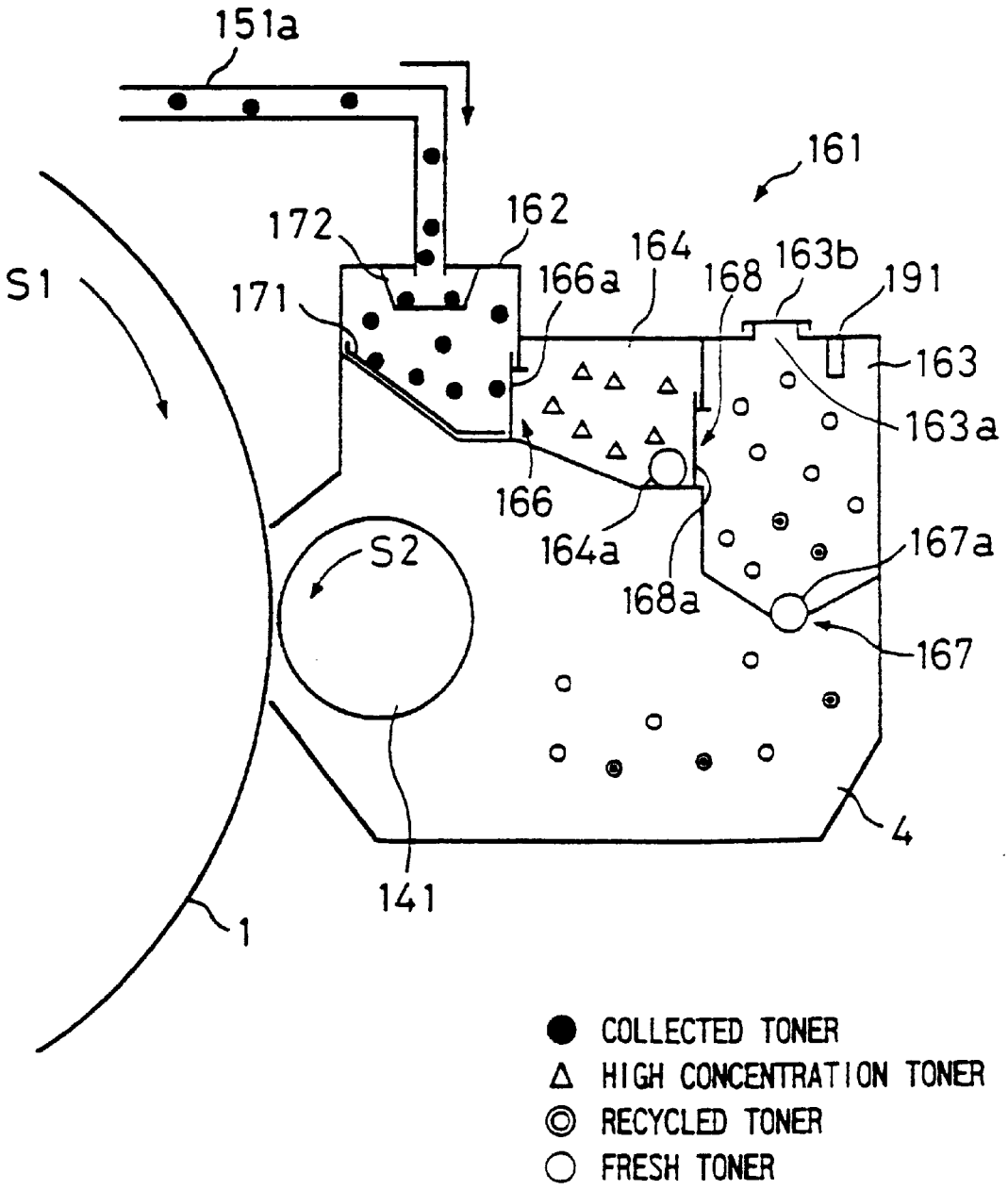
FIG. 9 is a sectional view showing a general configuration of a toner recycling portion.

Referring to FIG. 9, the following is an explanation of a specific configuration for recycling toner. FIG. 9 is a sectional view showing the general configuration of the toner recycling portion 161.

The toner recycling portion 161 is provided at the top of the developing unit 4. As mentioned above, the toner recycling portion 161 includes a collected residual toner storage 162, a high concentration toner accommodating portion 164, and a fresh toner storage 163, which are arranged next to one another. The high concentration toner accommodating portion 164 is a box-shaped cartridge accommodating a predetermined amount of high concentration toner, and is attached detachably. As shown in FIG. 9, the top of the fresh toner storage 163 is provided with an aperture portion 163*a* and a lid 163*b*, so that a predetermined amount of fresh toner can be accommodated and fresh toner can be supplied. Moreover, the conveyance path 166 between the collected residual toner storage 162 and the high concentration toner accommodating portion 164 is provided with a partition plate 166*a*, which can be opened and closed. In addition, the conveyance path 168 between the high concentration toner accommodating portion 164 and the fresh toner storage 163 is provided with a partition plate 168*a*, which can be opened and closed.

The conveyor pipe 151*a* is a hollow pipe and includes conveying means, such as conveyance screw 153 inside of it. Collected residual toner, which has been conveyed with the conveying means in the conveyance path 151 from the cleaning device 6 (not shown in the drawing) is filled in through the aperture portion provided at the top of the collected residual toner storage 162. This aperture portion is provided with means 172 for eliminating foreign matter composed of an internal lid portion shaped like a container, which eliminates foreign matter mixed into the collected residual toner and lets only collected residual toner pass. The foreign matter eliminating means 172 is explained in detail below.

The bottom of the collected residual toner storage 162 is provided with a toner detector 171 for detecting the amount of residual toner that has been collected. For this toner detector 171, for example, a weight sensor measuring the weight of the residual toner that has accumulated in the collected residual toner storage 162 is suitable.

When the collected residual toner detector 171 detects that the residual toner corresponds to a predetermined amount, the partition plate 166*a* closing off the conveyance path 166 is opened, and collected residual toner is loaded into the high concentration toner accommodating portion 164.

A stirring roller 164*a* is arranged near the partition plate 168*a* inside the high concentration toner accommodating portion 164, and recycled toner is produced by mixing while stirring a predetermined amount of high concentration toner stored in the high concentration toner accommodating portion 164 and a predetermined amount of collected residual toner that has been loaded from the collected residual toner storage 162. Mixing while stirring for a predetermined time, the partition plate 168*a*, which closes off the conveyance path 168, is shifted and the conveyance path 168 is opened, so that recycled toner is conveyed into the fresh toner storage 163 by the stirring roller 164*a*.

A replenishing roller 167*a* is arranged near the conveyance path 167 of the fresh toner storage 163. This replenishing roller 167*a* produces mixed toner by mixing while stirring a predetermined amount of fresh toner stored inside and a predetermined amount of recycled toner that has been conveyed from the high concentration toner accommodating portion 164. The mixed toner is supplied to the developing unit 4. A foamed elastic roller is used for the replenishing roller 167*a*.

Moreover, the fresh toner storage 163 is provided with a toner detector 191 for detecting the amount of toner inside the fresh toner storage 163. For this toner detector 191, it is suitable to use, for example, a weight sensor measuring the weight of the toner that has accumulated or an optical reflection sensor.

The top of the fresh toner storage 163 is provided with an aperture portion and a lid 163*b* for replenishing fresh toner. When replenishing fresh toner, the lid 163*b* is removed, and fresh toner is replenished from the aperture portion.

A developing roller 141 arranged inside the developing unit 4 supplies the mixed toner supplied to the developing unit 4 to the electrostatic latent image formed on the surface of the photosensitive drum 1, thereby making the electrostatic latent image visible as a toner image.

Figure 10A:
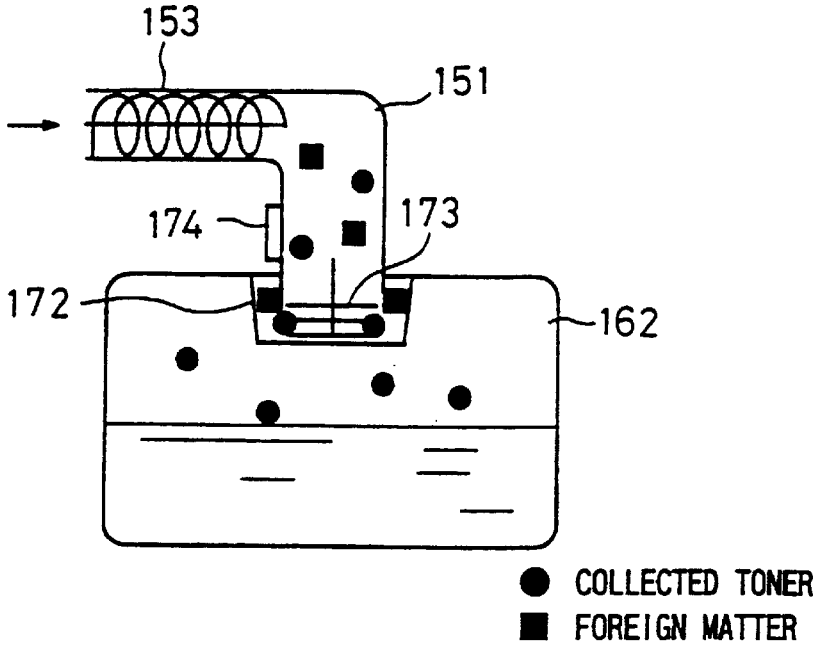
FIGS. 10A and 10B are sectional and perspective views showing a general configuration of foreign matter eliminating means.
Figure 10B:
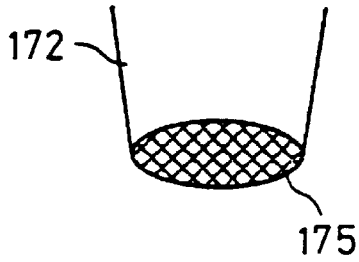

Referring to FIGS. 10A and 10B, the following is an explanation of the foreign matter eliminating means 172 provided near the aperture portion in the top of the collected residual toner storage 162. FIGS. 10A and 10B are a sectional view and a perspective view showing the general configuration of means 172 for eliminating foreign matter.

As noted above, the collected residual toner storage 162 is provided with means 172 for eliminating foreign matter, which is provided in the aperture portion at the top of the collected residual toner storage 162 arranged on one end of the conveyance path 151 as shown in FIG. 4, in order to eliminate impurities like foreign matter, such as paper particles, or toner coagulations from the collected residual toner. The foreign matter eliminating means 172 is composed of a container-shaped inner cup portion, and is provided with a mesh 175 at its bottom. The foreign matter eliminating means 172 is provided detachably in the collected residual toner storage 162, so that eliminated foreign matter or toner coagulations can be removed easily and reliably simply by detaching the foreign matter eliminating means 172 from the collected residual toner storage 162.

For the size of the holes in the mesh 175, a range of at least 20 $\mu$m and at most 200 $\mu$m, which is larger than the particle size of the collected residual toner passing through it and smaller than the particle size of foreign matter to be eliminated, is preferable. The particle size of the toner is usually 5 to 15 $\mu$m, whereas the minimum particle size of foreign matter is 200 $\mu$m, so that setting the size of the holes in the mesh 175 to this range, foreign matter or the like does not pass through the mesh 175 so that it can be separated and eliminated reliably, and clogging of the mesh 175 with collected residual toner can be avoided. Moreover, impeding the passage of relatively small toner coagulations of about 60 to 180 $\mu$m improves the image quality even further, so that it is even more preferable to set the size of the holes in the mesh 175 to a range of 20 to 50 $\mu$m.

Here, when the size of the aperture portions in the mesh 175 has been set to this range and foreign matter, such as paper particles, or toner coagulations accumulate increasingly in the foreign matter eliminating means 172, then collected residual toner of a particle size that is smaller than the aperture portions in the mesh 175 and which is reusable adheres to the foreign matter and accumulates in the foreign matter eliminating means 172 as well. This is why a stirring screw 173, serving as foreign matter stirring means for stirring the foreign matter and toner coagulations that have accumulated in the foreign matter eliminating means 172, is arranged on the inner side of the foreign matter eliminating means 172. Stirring the contents of the foreign matter eliminating means 172 with this stirring screw 173, recycled toner of small particle size passes the mesh 175 and accumulates in the collected residual toner storage 162, which improves the utilization factor of the recycled toner. Since it is not necessary to stir the accumulated contents of the foreign matter eliminating means 172 all the time, it is possible to let the stirring screw 173 rotate by itself, or connect it to the conveyance screw 153 provided in the conveyance path 151 for the collected residual toner and rotate them together. The stirring screw 173 is arranged in a shiftable fashion, so that the foreign matter eliminating means 172 can be easily detached.

A foreign matter sensor 174 serving as detection means for detecting the amount of contents accumulated in the foreign matter eliminating means 172 is provided near the foreign matter eliminating means 172. There is no particular restriction with regard to the foreign matter sensor 174, as long as it can detect the amount that has accumulated in the foreign matter eliminating means 172, and it is suitable to use, for example, an optical reflection sensor, an ultrasonic sensor, or a weight sensor.

Thus, the occurrence of image defects and damages on the surface of the photosensitive drum 1 can be prevented by eliminating foreign matter and toner coagulations in the collected residual toner with the mesh 175 in the collected residual toner storage 162.

Figure 11:
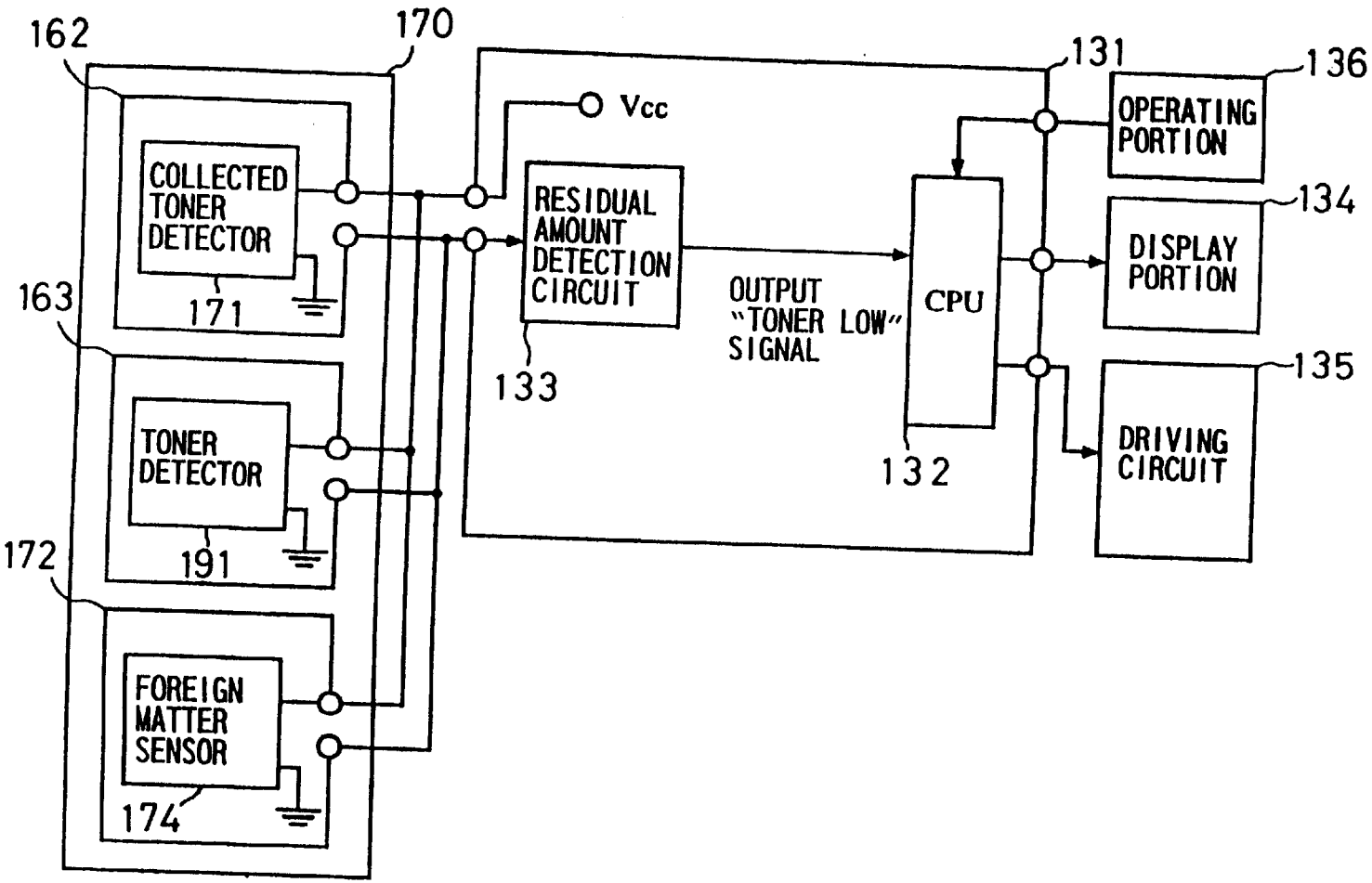
FIG. 11 is a block diagram showing a general configuration of a control system for controlling the operation of an image forming apparatus.

Referring to FIG. 11, the following is an explanation of the configuration of a control system for the recycling of toner in this image forming apparatus. FIG. 11 is a block diagram showing the general configuration of a control system controlling the operation of the image forming apparatus.

The control system of this image forming apparatus includes a control portion 131, a detector portion 170, a display portion 134 serving as notification means, a driving circuit 135, and an operating portion 136.

The control portion 131 includes a CPU 132 performing all kinds of controls and a residual amount detection circuit 133.

The CPU 132 is connected to the residual amount detection circuit 133, the display portion 134, the driving circuit 135, and the operating portion 136. The residual amount detection circuit 133 is connected to the collected residual toner detector 171, the toner detector 191, and the foreign matter sensor 174, which make up the detector portion 170.

The collected residual toner detector 171 detects the amount of residual toner that has been collected in the collected residual toner storage 162 and outputs a pulse signal corresponding to the result of this detection. The toner detector 191 detects the amount of toner that has accumulated in the fresh toner storage 163 and outputs a pulse signal corresponding to the result of this detection. The foreign matter sensor 174 detects the amount of foreign matter that has accumulated in the foreign matter eliminating means 172 and outputs a pulse signal corresponding to the result of this detection.

Based on the pulse signals from the collected residual toner detector 171, the toner detector 191 and the foreign matter sensor 174, the residual amount detection circuit 133 determines the amount of collected residual toner in the collected residual toner storage 162, the amount of mixed toner in the fresh toner storage 163 and the amount of foreign matter in the foreign matter eliminating means 172, and outputs to the CPU 132 a signal depending on these amounts.

Based on the signal sent from the residual amount detection circuit 133, the CPU 132 notifies the user with the display portion 134. The CPU 132 also controls the opening and closing of the partitions plates with the driving circuit 135 and the rotation of the rollers and screws.

The display portion 134 is a display unit provided on an operating portion (not shown in the drawings) of the image forming apparatus.

Figure 12:
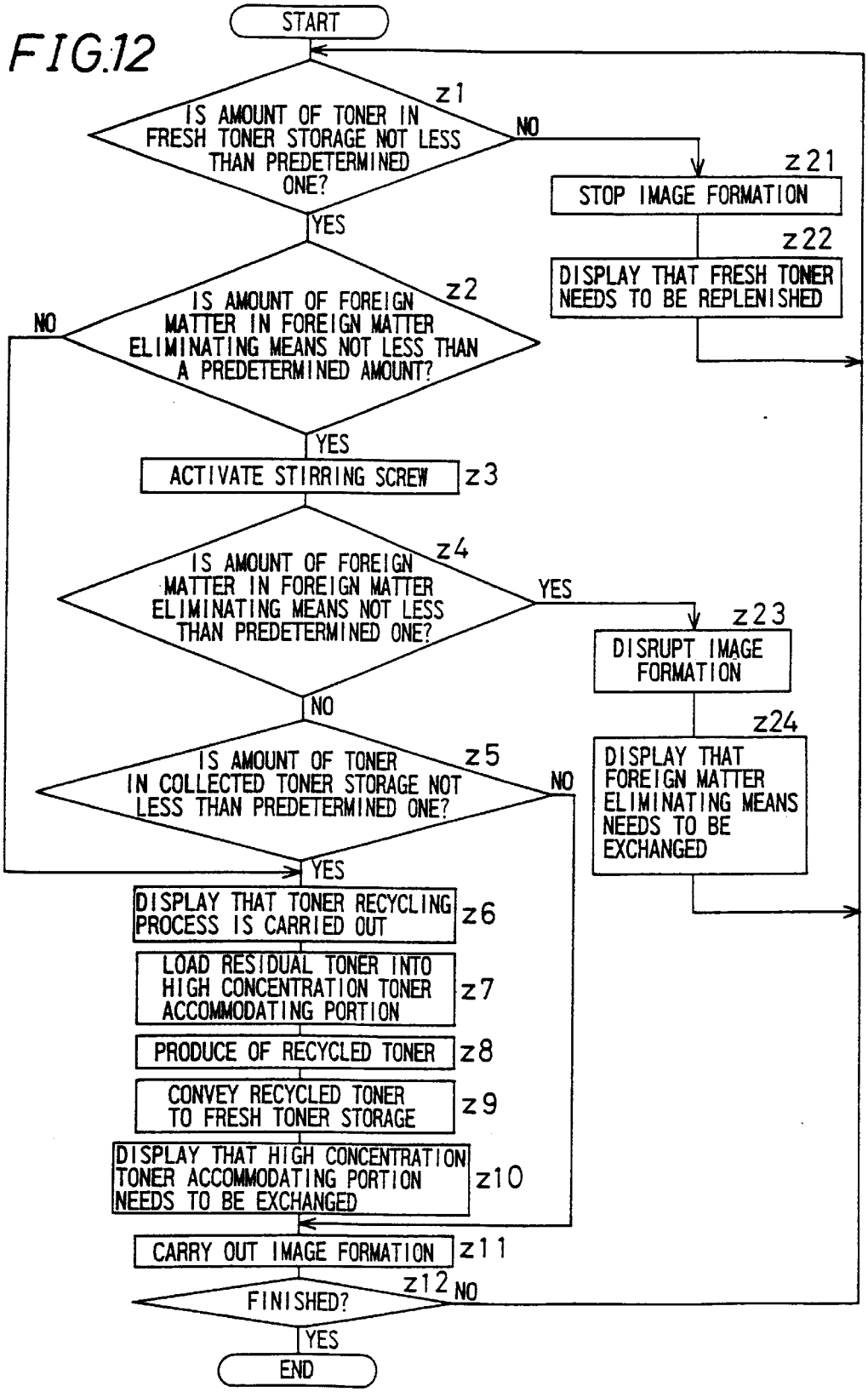
FIG. 12 is a flowchart illustrating the process flow of toner recycling in the image forming apparatus.

Referring to FIG. 12, the following is an explanation of the operation of the control system for recycling toner in this image forming apparatus. FIG. 12 is a flowchart showing the process flow of the toner recycling in the image forming apparatus.

When the user of the image forming apparatus starts an image formation by operating a start button (not shown in the drawings) provided on the operating portion 136, the CPU 132 decides whether the amount of toner in the fresh toner storage 163 is equal to or higher than a predetermined amount (z1). If it is lower than a predetermined amount, then the image formation is stopped (z21). Then, the CPU 132 displays a message on the display portion 134 that fresh toner has to be replenished and interrupts the image formation until the user has replenished fresh toner (z22). If, in that time, the user replenishes fresh toner and operates the start button (not shown in the drawings) provided on the operating portion 136, then the CPU 132 starts an image formation and returns to z1.

If, on the other hand, the amount of toner in the fresh toner storage 163 is equal to or higher than a predetermined amount, then the CPU 132 determines whether the amount of foreign matter in the foreign matter eliminating means 172 is higher than a predetermined amount. In the case where the amount of foreign matter is higher than a predetermined amount, then the stirring screw is activated to remove foreign matter from the collected residual toner(z3). Then, the CPU 132 determines again whether the amount of foreign matter in the collected residual toner in the foreign matter eliminating means 172 is higher than a predetermined amount (z4). If the amount of foreign matter is higher than a predetermined amount, then the image formation is stopped (z23). Then, the CPU 132 displays on the display portion 134 the message that it is necessary to exchange the foreign matter eliminating means 172 and interrupts the image formation until the user has exchanged the foreign matter eliminating means 172 (z24). If, in that time, the user replenishes fresh toner and operates the start button (not shown in the drawings) provided on the operating portion 136, then the CPU 132 starts an image formation and returns to z1.

If the amount of foreign matter at z4 is smaller than a predetermined amount, then the CPU 132 determines if the amount of residual toner in the collected residual toner storage 162 is equal to or higher than a predetermined amount (z5). If the amount of foreign matter at z2 is lower than a predetermined amount, then the CPU 132 proceeds to z5.

If the amount of residual toner in the collected residual toner storage 162 at z5 is equal to or higher than a predetermined amount, then the CPU 132 displays on the display portion 134 a message that recycled toner is produced (z6). Then a signal is sent to the driving circuit 135, the partition plate 166*a* provided in the conveyance path 166 between the collected residual toner storage 162 and the high concentration toner accommodating portion 164 is shifted to open the conveyance path 166 and load a predetermined amount of collected residual toner into the toner accommodating portion 164 accommodating toner with a high concentration of external additive (z7).

The CPU 132 sends a signal to the driving circuit 135, and the collected residual toner is mixed while being stirred with the stirring roller 164*a* for a predetermined time, which collected residual toner has been loaded into the high concentration toner accommodating portion 164 with the high concentration toner that it has been accommodating, so as to produce recycled toner (z8). Then, the CPU 132 sends a signal to the driving circuit 135 and shifts the partition plate 168*a* provided in the conveyance path 168 between the high concentration toner accommodating portion 164 and the fresh toner storage 163 to open the conveyance path 168 and convey the produced recycled toner to the fresh toner storage 163 by rotating the stirring roller (z9).

When the recycled toner is conveyed out of the high concentration toner accommodating portion 164, the high concentration toner in the high concentration toner accommodating portion 164 is depleted, so that the CPU 132 displays on the display portion 134 the message that it is necessary to exchange the high concentration toner accommodating portion 164 (z10). Then, the user exchanges the high concentration toner accommodating portion 164 (empty cartridge) with a new cartridge, operates the start button in the operating portion 136, to carry out an image formation (z11).

If in z5 the amount of collected residual toner in the collected residual toner storage 162 is not higher than a predetermined amount, then an image formation is carried out without performing toner recycling (z11).

After an image formation has been completed and the following image formation is to be performed (z12), the user starts the image formation by again operating the start button (not shown in the drawings) provided in the operating portion 136.

Figure 13:
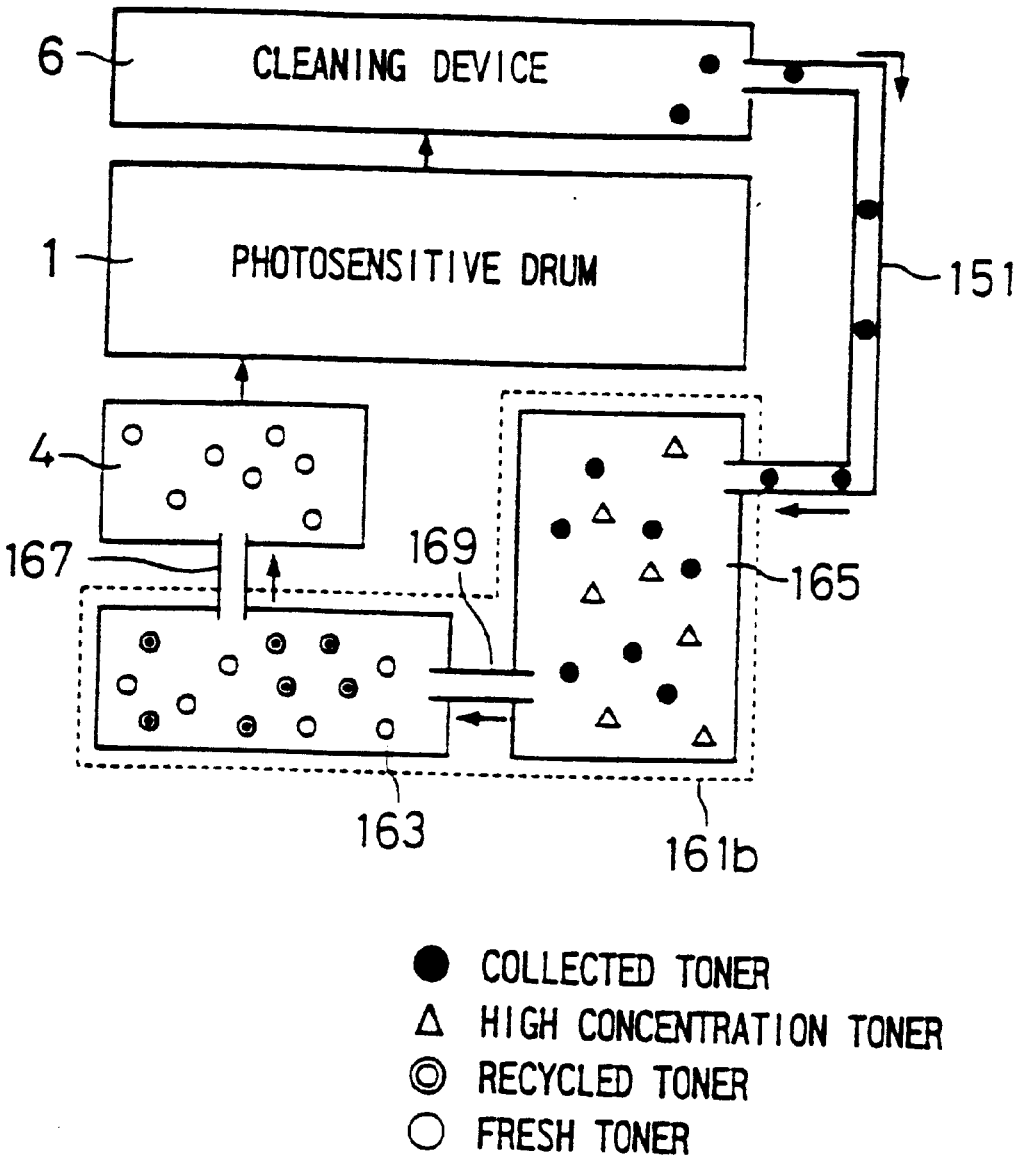
FIG. 13 is a block diagram showing another general configuration for recycling toner in the image forming apparatus.

Referring to FIG. 13, the following is an explanation of the general configuration of an image forming apparatus different from the configuration shown in FIG. 8. FIG. 13 is a block diagram showing another general configuration for recycling toner with an image forming apparatus of the invention.

Instead of the collected residual toner storage 162 and the high concentration toner accommodating portion 164 of the recycling portion 161 shown in FIG. 8, the configuration in FIG. 13 is provided with a toner accommodating portion 165. This toner accommodating portion 165 is connected with the conveyance path 151 and the conveyance path 169. Collected residual toner that has been conveyed from the cleaning device 6 through the conveyance path 151 is conveyed directly to the toner accommodating portion 165 accommodating high concentration toner without first being stored in a collected residual toner storage, and recycled toner is produced by mixing the collected residual toner and the high concentration toner while stirring. Except for the toner accommodating portion 165, the configuration is the same as the general configuration of the image forming apparatus shown in FIG. 8, so that further explanations have been omitted.

Figure 14:
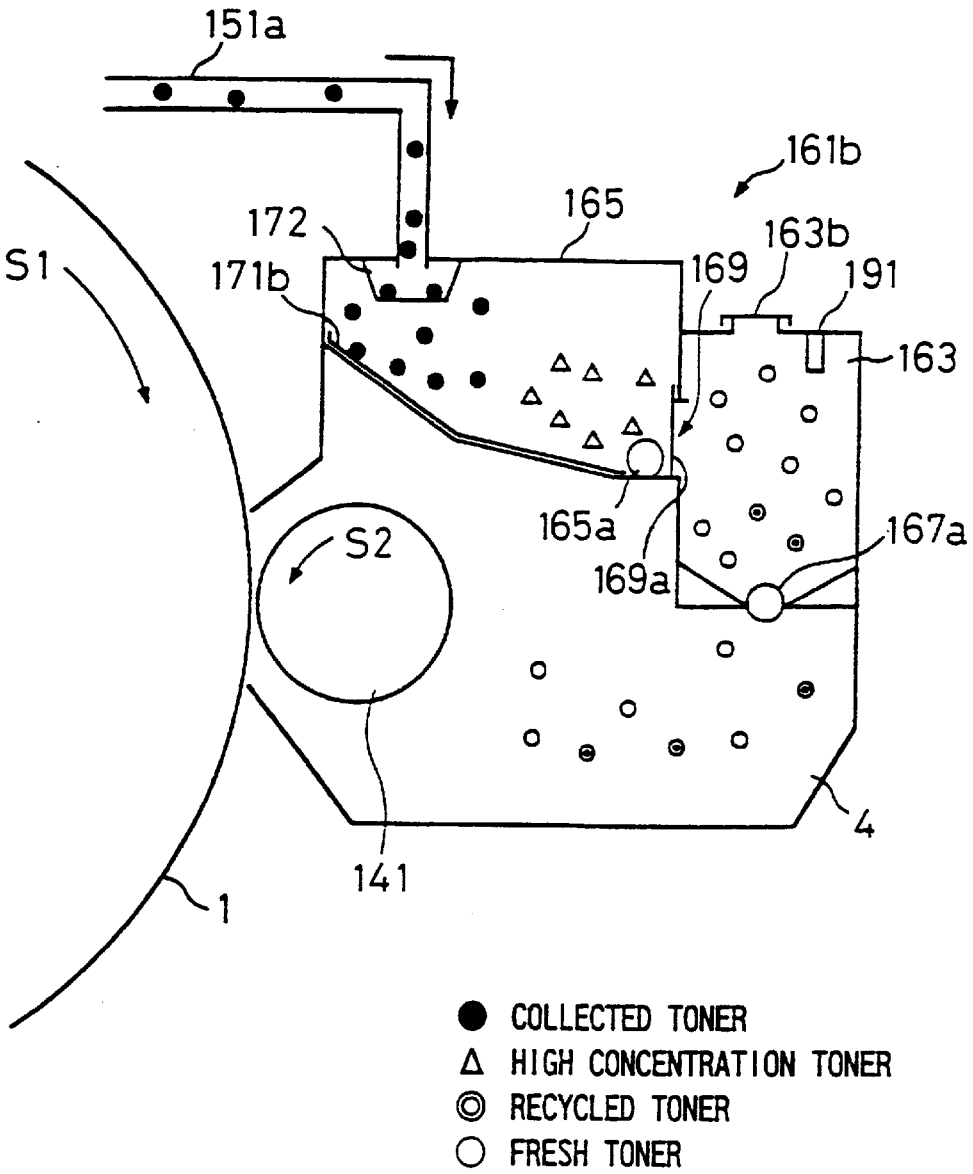
FIG. 14 is a sectional view showing a general configuration of a toner recycling portion.
Figure 15A:
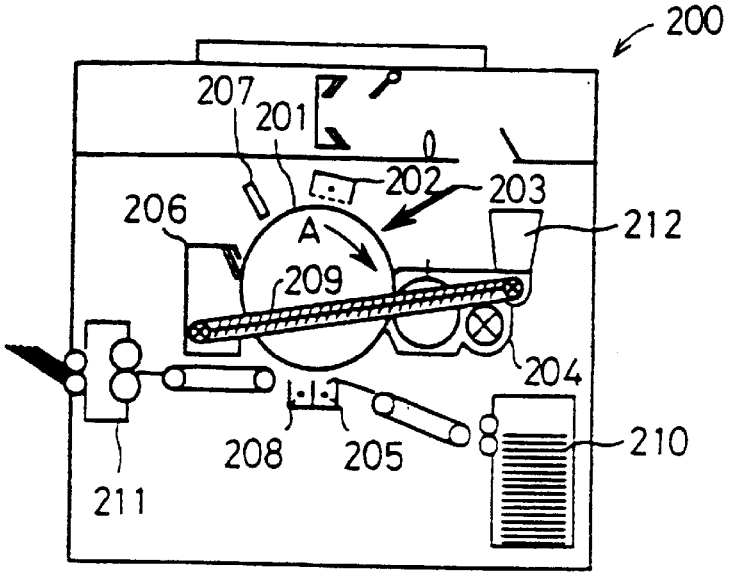
FIG.15A PRIOR ART
FIGS. 15A and 15B show a conventional image forming apparatus in which residual toner can be recycled.
Figure 15B:
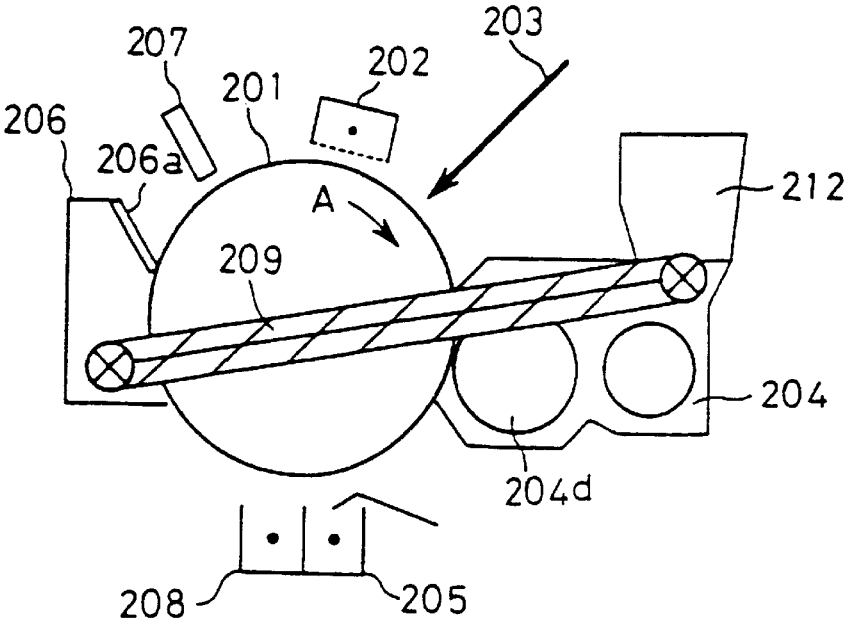
FIG.15B PRIOR ART

Referring to FIG. 14, the following is an explanation of a specific configuration for recycling toner. FIG. 14 is a sectional view showing the general configuration of a toner recycling portion 161*b*. Except for the toner accommodating portion, the toner recycling portion 161*b* in FIG. 14 has the same configuration as the toner recycling portion 161 shown in FIG. 9, so that only differing elements are explained.

The toner recycling portion 161*b* is provided at the top of the developing unit 4, and as noted above, it includes a toner accommodating portion 165 and a fresh toner storage 163, which are arranged next to one another. The toner accommodating portion 165 is a box-shaped cartridge accommodating a predetermined amount of high concentration toner, and is attached detachably. Moreover, the conveyance path 169 between the toner accommodating portion 165 and the fresh toner storage 163 is provided with a partition plate 169*a*, which can be opened and closed.

Collected residual toner is conveyed by conveying means in the conveyance path 151 from the cleaning device 6 (not shown in the drawing) and loaded through an aperture portion provided at the top of the toner accommodating portion 165. This aperture portion is provided with means 172 for eliminating foreign matter made of a container-shaped inner cup portion, which eliminates foreign matter mixed into the collected residual toner and lets only collected residual toner pass. The configuration of the foreign matter eliminating means 172 is the same as shown in FIGS. 10A and 10B.

A toner detector 171*b* for detecting the amount of collected residual toner is provided at the bottom of the toner accommodating portion 165. For this toner detector 171*b*, for example, a weight sensor measuring the weight of the collected residual toner and the high concentration toner that have accumulated in the toner accommodating portion 165 is suitable.

A stirring roller 165*a* is arranged inside the toner accommodating portion 165, where a predetermined amount of high concentration toner stored therein and a predetermined amount of collected residual toner that has been conveyed from the cleaning device 6 are mixed while being stirred to produce recycled toner. When, after stirring for a predetermined time, the collected residual toner detector 171*b* detects that the collected residual toner corresponds to a predetermined amount, the partition plate 169*a* closing off the conveyance path 169 is opened, and recycled toner is conveyed to the fresh toner storage 163 by the stirring roller 165*a*.

In the fresh toner storage 163 and the developing unit 4, the same processes are performed as in the configuration shown in FIG. 9.

In the embodiment shown in FIG. 14, no space is necessary for storing the collected residual toner, which makes it possible to realize a toner recycling portion requiring less space in the image forming apparatus. Furthermore, the steps for producing recycled toner can be eliminated, and it is possible to speed up the toner recycling process.

As described in the foregoing, the invention focuses on the fact that a reason for the functional deterioration of the collected residual toner is the change of the composition of the toner (i.e. the reduction of the external additive). That is to say, during progressive steps of developing, transferring, and cleaning, the external additive secedes from the toner or becomes embedded in the toner particles, so that the amount of external additive in the collected residual toner decreases. Therefore, if the collected residual toner is recycled as it is, its developing properties worsen and improper cleaning may occur, as well as the covering the document with toner and the scattering of toner.

With the toner recycling portion 161 or 161*b* of the invention, recycled toner of high quality can be attained by restoring the changed composition to fundamentally recover the quality of the toner, which is accomplished by mixing collected residual toner while stirring in a high concentration toner accommodating portion 164 or a toner accommodating portion 165 into which fresh toner with an external additive concentration as given in equation (3) has been introduced. Thus, the image forming apparatus of the invention suppresses the covering the document with toner and the scattering of toner and can constantly output images with consistently high reflection image density.

For the image forming apparatus of the invention, configurations were given, in which the user is notified of a toner shortage in the fresh toner storage 163 or of guidance regarding the production of recycled toner with the display portion 134 serving as a display unit. However, it is also possible to notify the user by voice using a voice synthesizer or the like.

In the image forming apparatus of the invention, regular toner can be used without problems, but for the high concentration toner stored in the high concentration toner accommodating portion 164 and the toner accommodating portion 165, it is preferable to use the same external additive and toner particles as used in the fresh toner replenished and stored in the fresh toner storage 163.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a developing unit for supplying toner to an electrostatic latent image formed on an electrostatic latent image carrier and making the electrostatic latent image visible as a visible toner image;

a transfer device for transferring the visible toner image onto a transfer material;

a cleaning device for collecting residual toner remaining on the electrostatic latent image carrier after the transferring of the visible toner image;

a conveyor device for conveying residual toner that has been collected by the cleaning device, to the developing unit;

a toner recycling portion for producing recycled toner by supplementing an external additive to the collected residual toner conveyed to the developing unit, to reuse for image formation; and means for determining whether or not to supplement the external additive to the collected residual toner based upon detection of an amount of residual toner in a collected residual toner storage.

2. The image forming apparatus of claim 1, wherein the external additive is a powder of at least one of silica, alumina and titania.

3. The image forming apparatus of claim 1, wherein the toner recycling portion includes foreign matter eliminating means for eliminating foreign matter that is contained in the collected residual toner.

4. The image forming apparatus of claim 3, wherein the foreign matter eliminating means is cup-shaped, at least a bottom portion of the foreign matter eliminating means is made of a mesh, and the foreign matter eliminating means is provided detachably in an aperture portion of the toner recycling portion.

5. The image forming apparatus of claim 4, wherein the size of holes in the mesh of the foreign matter eliminating means is larger than a diameter of residual toner particles to be recycled and smaller than a particle diameter of the foreign matter to be eliminated.

6. The image forming apparatus of claim 1, wherein the toner recycling portion includes the collected residual toner storage for storing collected residual toner; an external additive cartridge for storing the external additive; and a connection portion connecting the collected residual toner storage and the external additive cartridge.

7. The image forming apparatus of claim 6, wherein the external additive cartridge is attached detachably to a top of the collected residual toner storage.

8. The image forming apparatus of claim 6, wherein the collected residual toner storage includes stirring means for stirring the collected residual toner and the external additive.

9. The image forming apparatus of claim 1, wherein the toner recycling portion includes a fresh toner storage in which recycled toner is mixed with fresh toner; and a connection portion for connecting the fresh toner storage with the collected residual toner storage.

10. An image forming apparatus comprising:

a developing unit for supplying toner to an electrostatic latent image formed on an electrostatic latent image carrier and making the electrostatic latent image visible as a visible toner image;

a transfer device for transferring the visible toner image onto a transfer material;

a cleaning device for collecting residual toner remaining on the electrostatic latent image carrier after the transferring of the visible toner image;

a conveyor device for conveying residual toner that has been collected by the cleaning device, to the developing unit; and a toner recycling portion for producing recycled toner by supplementing an external additive to the collected residual toner conveyed to the developing unit, to reuse for image formation;

wherein an amount of the external additive which is supplemented to the collected residual toner in the toner recycling portion satisfies the following equation:

$$0.9Y-X \leftarrow Z \leftarrow 1.1Y-X$$

wherein Y(% by weight) is weight ratio of external additive contained in fresh toner, and X(% by weight) is weight ratio of external additive contained in the collected residual toner, and Z(% by weight) is weight ratio of the external additive to be supplemented to the collected residual toner.

11. An image forming apparatus comprising:

a developing unit for supplying toner to an electrostatic latent image formed on an electrostatic latent image carrier and making the electrostatic latent image visible as a visible toner image;

a transfer device for transferring the visible toner image onto a transfer material;

a cleaning device for collecting residual toner remaining on the electrostatic latent image carrier after the transferring of the visible toner image;

a conveyor device for conveying residual toner that has been collected by the cleaning device, to the developing unit; and a toner recycling portion for producing recycled toner by supplementing an external additive to the collected residual toner conveyed to the developing unit, to reuse for image formation;

wherein the toner recycling portion includes a collected residual toner storage for storing collected residual toner; an external additive cartridge for storing the external additive; and a connection portion connecting the collected residual toner storage and the external additive cartridge; and wherein the external additive cartridge is provided with an aperture portion sealed with a heat seal, which connects the external additive cartridge with the collected residual toner storage when the heat seal is removed.

12. An image forming apparatus comprising:

a developing unit for supplying toner to an electrostatic latent image formed on an electrostatic latent image carrier and making the electrostatic latent image visible as a visible toner image;

a transfer device for transferring the visible toner image onto a transfer material;

a cleaning device for collecting residual toner remaining on the electrostatic latent image carrier after the transferring of the visible toner image;

a conveyor device for conveying residual toner that has been collected by the cleaning device, to the developing unit; and a toner recycling portion for producing recycled toner by supplementing an external additive to the collected residual toner conveyed to the developing unit, to reuse for image formation;

wherein the toner recycling portion includes a collected residual toner storage for storing collected residual toner; an external additive cartridge for storing the external additive; and a connection portion connecting the collected residual toner storage and the external additive cartridge;

collected residual toner detection means for detecting an amount of toner in the collected residual toner storage; and notification means for notifying, when the amount of toner detected by the collected residual toner detection means has reached an amount equal to or larger than a first predetermined amount.

13. The image forming apparatus of claim 12, further comprising:

control means for stopping image formation when the toner amount detected by the collected residual toner detection means has reached a second predetermined amount.

14. An image forming apparatus comprising:

a developing unit for supplying toner to an electrostatic latent image formed on an electrostatic latent image carrier and making the electrostatic latent image visible as a visible toner image;

a transfer device for transferring the visible toner image onto a transfer material;

a cleaning device for collecting residual toner remaining on the electrostatic latent image carrier after the transferring of the visible toner image;

a conveyor device for conveying residual toner that has been collected by the cleaning device, to the developing unit; and a toner recycling portion for producing recycled toner by supplementing an external additive to the collected residual toner conveyed to the developing unit, to reuse for image formation;

wherein the toner recycling portion includes a fresh toner storage in which recycled toner is mixed with fresh toner; and a connection portion for connecting the fresh toner storage with a collected residual toner storage; and wherein the fresh toner storage includes fresh toner detection means for detecting a toner amount; and notification means for notifying, when the amount of toner detected by the fresh toner detection means has decreased to an amount equal to or smaller than a predetermined amount.

15. An image forming apparatus comprising:

a developing unit for supplying toner to an electrostatic latent image that has been formed on an electrostatic latent image carrier to form a toner image;

a transfer device for transferring the toner image onto a transfer material;

a cleaning device for eliminating and collecting residual toner remaining on the surface of the electrostatic latent image carrier after transferring the toner image;

a toner recycling portion for producing recycled toner by stirring collected residual toner that has been collected with the cleaning device and high concentration toner containing an external additive whose concentration is higher than that of fresh toner, to reuse as recycled toner for image formation; and at least one circuit for determining whether or not to add the external additive based at least in part upon detection of an amount of residual toner in a collected residual toner storage.

16. The image forming apparatus of claim 15, wherein the external additive is a powder of at least one of silica, alumina and titania.

17. The image forming apparatus of claim 15, wherein the toner recycling portion includes detachable foreign matter eliminating means for eliminating foreign matter that is contained in the collected residual toner.

18. The image forming apparatus of claim 17, wherein the foreign matter eliminating means is cup-shaped, at least a bottom portion of the foreign matter eliminating means is composed of a mesh, and a size of holes in the mesh is larger than a diameter of toner particles to be recycled and smaller than a particle diameter of the foreign matter to be eliminated.

19. The image forming apparatus of claim 17, wherein the foreign matter eliminating means includes foreign matter stirring means for stirring the matter collected in the foreign matter eliminating means.

20. The image forming apparatus of claim 15, wherein the toner recycling portion includes the collected residual toner storage for storing collected residual toner; a high concentration toner accommodating portion for accommodating high concentration toner containing an external additive whose concentration is higher than that of fresh toner; a conveyance path for conveying collected residual toner from the collected residual toner storage to the high concentration toner accommodating portion; and stirring means for stirring toner in the high concentration toner accommodating portion.

21. The image forming apparatus of claim 20, wherein the toner recycling portion includes a fresh toner storage for storing fresh toner; a conveyance path for conveying recycled toner from the high concentration toner accommodating portion to the fresh toner storage; and stirring means for stirring toner in the fresh toner storage.

22. The image forming apparatus of claim 21, wherein the fresh toner storage includes detection means for detecting an amount of toner stored in the fresh toner storage; and notification means for notifying, when the amount of toner has decreased to a predetermined amount.

23. The image forming apparatus of claim 15, wherein the toner recycling portion includes a toner accommodating portion for accommodating high concentration toner containing an external additive whose concentration is higher than that of fresh toner; a conveyance path for conveying collected residual toner that has been collected with the cleaning device to the toner accommodating portion; and stirring means for stirring the toner in the toner accommodating portion.

24. An image forming apparatus comprising:

a developing unit for supplying toner to an electrostatic latent image that has been formed on an electrostatic latent image carrier to form a toner image;

a transfer device for transferring the toner image onto a transfer material;

a cleaning device for eliminating and collecting residual toner remaining on the surface of the electrostatic latent image carrier after transferring the toner image;

a toner recycling portion for producing recycled toner by stirring collected residual toner that has been collected with the cleaning device and high concentration toner containing an external additive whose concentration is higher than that of fresh toner, to reuse as recycled toner for image formation; and wherein the external additive has a hydrophobicity of at least 40%.

25. An image forming apparatus comprising:

a developing unit for supplying toner to an electrostatic latent image that has been formed on an electrostatic latent image carrier to form a toner image;

a transfer device for transferring the toner image onto a transfer material;

a cleaning device for eliminating and collecting residual toner remaining on the surface of the electrostatic latent image carrier after transferring the toner image;

a toner recycling portion for producing recycled toner by stirring collected residual toner that has been collected with the cleaning device and high concentration toner containing an external additive whose concentration is higher than that of fresh toner, to reuse as recycled toner for image formation; and wherein the external additive contained in the high concentration toner satisfies the following equation:

$$1.9Y-X \leftarrow Z \leftarrow 2.1Y-X$$

wherein Y(% by weight) is weight ratio of external additive contained in fresh toner, X(% by weight) is weight ratio of external additive contained in the collected residual toner, and Z(% by weight) is weight ratio of the external additive contained in the high concentration toner.

26. An image forming apparatus comprising:

a developing unit for supplying toner to an electrostatic latent image that has been formed on an electrostatic latent image carrier to form a toner image;

a transfer device for transferring the toner image onto a transfer material;

a cleaning device for eliminating and collecting residual toner remaining on the surface of the electrostatic latent image carrier after transferring the toner image;

a toner recycling portion for producing recycled toner by stirring collected residual toner that has been collected with the cleaning device and high concentration toner containing an external additive whose concentration is higher than that of fresh toner, to reuse as recycled toner for image formation;

wherein the toner recycling portion includes detachable foreign matter eliminating means for eliminating foreign matter that is contained in the collected residual toner; and wherein the foreign matter eliminating means includes foreign matter detection means for detecting an amount of matter collected in the foreign matter eliminating means; and notification means for notifying, when the amount of collected matter has reached a predetermined amount.

27. An image forming apparatus comprising:

a developing unit for supplying toner to an electrostatic latent image that has been formed on an electrostatic latent image carrier to form a toner image;

a transfer device for transferring the toner image onto a transfer material;

a cleaning device for eliminating and collecting residual toner remaining on the surface of the electrostatic latent image carrier after transferring the toner image;

a toner recycling portion for producing recycled toner by stirring collected residual toner that has been collected with the cleaning device and high concentration toner containing an external additive whose concentration is higher than that of fresh toner, to reuse as recycled toner for image formation;

wherein the toner recycling portion includes a collected residual toner storage for storing collected residual toner; a high concentration toner accommodating portion for accommodating high concentration toner containing an external additive whose concentration is higher than that of fresh toner; a conveyance path for conveying collected residual toner from the collected residual toner storage to the high concentration toner accommodating portion; and stirring means for stirring toner in the high concentration toner accommodating portion; and wherein the collected residual toner storage includes toner detection means for detecting an amount of toner stored in the collected residual toner storage; and means for conveying toner that has been stored in the collected residual toner storage to the high concentration toner accommodating portion.

28. An image forming apparatus comprising:

a developing unit for supplying toner to an electrostatic latent image that has been formed on an electrostatic latent image carrier to form a toner image;

a transfer device for transferring the toner image onto a transfer material;

a cleaning device for eliminating and collecting residual toner remaining on the surface of the electrostatic latent image carrier after transferring the toner image;

a toner recycling portion for producing recycled toner by stirring collected residual toner that has been collected with the cleaning device and high concentration toner containing an external additive whose concentration is higher than that of fresh toner, to reuse as recycled toner for image formation;

wherein the toner recycling portion includes a toner accommodating portion for accommodating high concentration toner containing an external additive whose concentration is higher than that of fresh toner; a conveyance path for conveying collected residual toner that has been collected with the cleaning device to the toner accommodating portion; and stirring means for stirring the toner in the toner accommodating portion; and wherein the toner accommodating portion includes toner detection means for detecting an amount of toner accommodated by the toner accommodating portion, and means for conveying toner that is accommodated by the toner accommodating portion to a fresh toner storage.

* * * * *